US012623123B1

(12) United States Patent
Evans et al.

(10) Patent No.: US 12,623,123 B1
(45) **Date of Patent: *May 12, 2026**

(54) LOW DRAG GOLF CLUB HEAD WITH IMPROVED MASS PROPERTIES

(71) Applicant: Cobra Golf Incorporated, Carlsbad, CA (US)

(72) Inventors: D. Clayton Evans, Vista, CA (US); Michael S. Yagley, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 1064 days.

This patent is subject to a terminal disclaimer.

(21) Appl. No.: 17/578,124

(22) Filed: Jan. 18, 2022

Related U.S. Application Data

(63) Continuation-in-part of application No. 16/708,691, filed on Dec. 10, 2019, now abandoned, which is a continuation of application No. 15/827,163, filed on Nov. 30, 2017, now Pat. No. 10,532,254.

(60) Provisional application No. 62/582,521, filed on Nov. 7, 2017.

(51) Int. Cl.
*A63B 53/04* (2015.01)

(52) U.S. Cl.
CPC ..... *A63B 53/0466* (2013.01); *A63B 53/0437* (2020.08); *A63B 2053/0491* (2013.01); *A63B 2209/00* (2013.01)

(58) Field of Classification Search
CPC ..... A63B 53/0466; A63B 53/0437; A63B 2053/0491; A63B 2209/00; A63B 2225/01
See application file for complete search history.

(56) References Cited

U.S. PATENT DOCUMENTS

| | | | | |
|---|---|---|---|---|
| 5,397,127 | A * | 3/1995 | Kawada | A63B 53/0466 473/331 |
| 5,497,995 | A | 3/1996 | Swisshelm | |
| 5,989,134 | A | 11/1999 | Antonious | |
| 6,056,649 | A | 5/2000 | Imai | |
| 6,572,489 | B2 * | 6/2003 | Miyamoto | A63B 53/0466 473/290 |
| 6,969,326 | B2 | 11/2005 | De Shiell et al. | |
| 7,361,100 | B1 | 4/2008 | Morales et al. | |

(Continued)

OTHER PUBLICATIONS

Hilton, 2012, Cobra golf release two new special edition drivers, The Sand Trap, published Aug. 5, 2012, on https://thesandtrap.com/b/bag_drop/cobra_golf_release_two_new_special_edition_drivers (8 pages).

*Primary Examiner* — Michael D Dennis
(74) *Attorney, Agent, or Firm* — Quarles & Brady LLP

(57) ABSTRACT

A golf club head includes a body defining an internal cavity. The body includes a crown portion, a sole portion, a skirt portion extending along a perimeter of an aft side of the body between the crown portion and the sole portion, and a hosel extending from a heel side of the body. The skirt portion includes a distalmost point along a toe side of the body. The hosel defines a hosel axis that intersects a ground plane at a ground intersection point. The crown portion includes a vertex point adjacent to the hosel that defines vertex height in a direction normal to the ground plane. The vertex height is less than 75% of a maximum height of the body, and a height of the distalmost point in a direction normal to the ground plane is less than 65% of the maximum height of the body.

17 Claims, 29 Drawing Sheets

(56) References Cited

U.S. PATENT DOCUMENTS

| | | | | |
|---|---|---|---|---|
| 7,431,664 | B2 | 10/2008 | Meyer et al. | |
| 8,177,659 | B1 | 5/2012 | Ehlers | |
| 8,371,957 | B2 | 2/2013 | Schweigert | |
| 8,568,247 | B1 | 10/2013 | Ehlers | |
| 9,492,721 | B2 | 11/2016 | Ghods et al. | |
| 9,504,889 | B2 | 11/2016 | Mitzel et al. | |
| 9,526,954 | B2 | 12/2016 | Oldknow | |
| 10,035,049 | B1 | 7/2018 | Nielson | |
| 10,532,254 | B1 * | 1/2020 | Evans | A63B 53/0466 |
| 10,596,421 | B1 * | 3/2020 | Myers | A63B 60/50 |
| 2003/0087710 | A1 | 5/2003 | Sheets et al. | |
| 2004/0116207 | A1 | 6/2004 | DeShiell et al. | |
| 2007/0155533 | A1 | 7/2007 | Solheim et al. | |
| 2007/0212190 | A1 * | 9/2007 | Monday | F16B 23/0015 411/85 |
| 2009/0258725 | A1 * | 10/2009 | Jones | A63B 53/0487 473/341 |
| 2011/0165961 | A1 | 7/2011 | Cackett et al. | |
| 2011/0250986 | A1 * | 10/2011 | Schweigert | A63B 60/02 473/409 |
| 2012/0172147 | A1 | 7/2012 | McDonnell et al. | |
| 2013/0178305 | A1 | 7/2013 | Beno et al. | |
| 2013/0178306 | A1 | 7/2013 | Beno et al. | |
| 2015/0367185 | A1 * | 12/2015 | Vrska | G09F 23/0066 473/305 |
| 2017/0001082 | A1 | 1/2017 | DeShiell et al. | |
| 2017/0189770 | A1 | 7/2017 | Hettinger et al. | |

* cited by examiner

LOW DRAG GOLF CLUB HEAD WITH IMPROVED MASS PROPERTIES

CROSS REFERENCE TO RELATED APPLICATIONS

The present application is a continuation in part of U.S. patent application Ser. No. 16/708,691, filed on Dec. 10, 2019, which is a continuation of U.S. patent application Ser. No. 15/827,163, filed on Nov. 30, 2017 and now issued as U.S. Pat. No. 10,532,254, which claims priority to U.S. Provisional Patent Application No. 62/582,521, filed on Nov. 7, 2017. Each of the foregoing patent applications and issued patents are incorporated herein by reference in their entirety.

REFERENCE REGARDING FEDERALLY SPONSORED RESEARCH OR DEVELOPMENT

Not applicable.

SEQUENCE LISTING

Not applicable.

BACKGROUND

1. Field of the Invention

The present disclosure relates generally to a golf club head.

2. Description of the Background

Golf is a challenging sport and a social experience. Golfers of differing abilities enjoy playing together. Typically, any golfer-regardless of ability-desires the ability to make long and consistent shots. Some golf club designers have tried heel-toe mass distributions to give more consistent shots. Unfortunately, with existing clubs, the distance of a shot may be limited by extrinsic factors such as the maximum velocity of swing speeds. As such, within a group of golfers, stronger individuals will tend to have an advantage at making longer drives compared to other members of the group. Thus, golfers will typically refer to handicaps to make score comparisons meaningful and to allow groups of golfers to enjoy golf together.

SUMMARY

In one aspect, an example golf club head includes a ball-striking face, a crown, a sole, and a weight. The crown extends from a top of the ball-striking face. The sole extends from a bottom of the ball-striking face and meets the crown to define an internal cavity and a trailing edge at a height between 40% and 70% of a height of the golf club head, such that an amount of work required to achieve a golf club head swing speed of 100 mph is less than or equal to 6 joules. The weight is disposed in the internal cavity such that a club head center of gravity is located within 3 millimeters of an idealized axis extending through and normal to the ball striking face, the weight being more dense than the sole.

In another aspect, an example golf club head includes a ball-striking face, a crown, and a sole. The crown extends from a top of the ball-striking face. The sole extends from a bottom of the ball-striking face and meets the crown to define a trailing edge at a height greater than 40% of a height of the golf club head. External surfaces of the ball-striking face, the crown, and the sole are smoothly and transitionally connected to one another to reduce air drag such that an amount of work required to achieve a golf club head swing speed of 100 mph is less than or equal to 6 joules.

In yet another aspect, an example golf club head includes a ball-striking face, a crown, and a weight. The crown is connected to the ball-striking face. The sole is connected to the ball-striking face and the crown. The sole, the ball-striking face, and the crown define an internal cavity. The weight is disposed in the internal cavity such that a club head center of gravity is located within 3 millimeters of an idealized axis extending through and normal to the ball-striking face.

The disclosure relates to golf club heads with aerodynamic properties optimized to make very long shots. Aerodynamic properties are optimized by means of a trailing edge of the club head being lifted very high in comparison to existing club heads, and in which the club head includes a protruding element, such as a strut with a weight on the ends extending down from the sole, to maintain an optimal center of gravity location despite the dramatically raked trailing edge. The dramatic upwards rake as the sole reaches the trailing edge reduces aerodynamic drag on a club head during a swing and thus reduces the work required for the club head to move through the air. Thus, the club heads allow golfers to achieve faster golf swing velocities and increase golf shot distances.

Embodiments of the present disclosure describe golf club heads having low drag and optimized center of gravity (CG) location by virtue of a raised trailing edge (compared to existing clubs). The club head is designed with a trailing edge positioned at a height, when the club head is at address, selected to minimize drag experienced by the club head during a golf swing, resulting in faster swing speeds. To offset any potential effect that the raised trailing edge may have on a location of the club head CG, the club head may include a weighted protruding element extending from a sole of the club head. The protruding weight positions the club head CG low and close to a neutral axis of the club (an idealized axis normal to, and extending through, a center of a ball-striking face of the club head). Additionally, the club head may have a crown that includes a lightweight material such as a composite, plastic, carbon fiber, etc., to contribute to lowering the club head CG.

Because the reduced drag provides faster swing speeds, more energy can be transferred to a golf ball resulting in ball impacts with greater ball velocity, lowered spin, and desired launch angle that also increases the overall distance the ball travels. Positioning the protruding weight member rearward on the sole can also increase a moment of inertia of the club head about a vertical axis when the club head is at address (MOIz). Due to the increased MOIz, energy transfer is optimized for off-center ball impacts on the club head's ball-striking face.

Advantageously, the design of each golf club head described herein reduces the drag force on the club head over a substantial portion of a golf swing and consequently reduces the amount of work required (e.g., ≤6 J) to move the club head through the air, along its path, by a maximum of about 40%. As such, a golfer can achieve faster swing velocities using the golf club head described herein because the reduced drag force on the club head requires less work from the golfer to move the club head through the air. The faster swing velocities result in a dramatic increase in energy transfer to a golf ball at impact because the kinetic energy (K) of any object (e.g., the golf club head) according to Newtonian physics has a quadratic relationship with the object's velocity (i.e., K=(½) mv^2). Furthermore, the design maintains an optimal club head CG and a high MOIz. Due to the optimal CG, shots go great distances and due to the high MOIz, the club head is forgiving to off-center hits, and shots consistently travel straight.

One aspect of the present disclosure provides a golf club head comprising a ball-striking face, a crown, sole, and the trailing edge. The crown extends back from a top of the ball-striking face and the sole extends back from a bottom of the ball-striking face. The trailing edge of the crown is defined by a meeting of the crown and the sole. The height of the trailing edge, as defined when the club head is at address, is selected to reduce drag the golf club head experiences during a golf swing.

In some embodiments, the height of the trailing edge can have a value that is greater than 30% and less than or equal to 95% (preferably between about 34 and 70%) of a crown-to-sole height of the golf club head as defined when the club head is at address. Additionally, the height of the trailing edge can be selected such that an amount of work required to achieve a golf club swing speed greater than or equal to 100 mph is less than or equal to 6 joules. In other embodiments, the reduced drag can be promoted by a delay in airflow separation occurring at a point closer to the aft of the club head than the leading edge of the crown.

The golf club head's center of gravity (CG) can be positioned to optimize energy transfer from the club head to a golf ball. In some embodiments, the golf club head comprises a protruding element coupled to the sole to position the club head CG. For example, the protruding element can position the CG within a few millimeters (mm) of an axis normal to and passing through a center point of the ball-striking surface. In certain examples, the CG can be positioned at most 3 mm, at most 2 mm, or between 2 mm and 3 mm from the axis. The CG can also be defined as being positioned about or on the neutral axis, which is perpendicular to a surface defined by the ball-striking face and normal to a center point of the ball-striking face. Although the neutral axis is not a physical component of the club head, a skilled artisan will understand that it is an idealized axis used to describe an orientation of the club head and a positional relationship between components of the club head.

The club head CG is influenced by a location and mass of the protruding element. For example, the protruding element can be coupled to an aft section of the sole and a weight of the protruding element can be selected to position the CG at a low point along and either on or about the axis. The protruding element can be coupled to the sole. Optionally, a weighted screw can couple the protruding element to the sole. The protruding element may have an aerodynamic design to minimize drag on the club head during a golf swing. Additionally, the protruding element can have a portion with density that is at least about 11 grams per cubic centimeter (g/cm^3) or greater. A material of the protruding element may be selected such that its density allows a size of the protruding element to be minimized, to minimize drag.

In other embodiments, the CG of the golf club head can further be positioned by at least one of: a weighted screw, a weight of a portion of the crown, and a weight of a body of the club head. For example, a portion of the crown may include a composite material. The composite material can have a weight that is less than that of the protruding element. The crown may be bonded to a body of the golf club head, which, in further aspects, can comprise a metallic material such as titanium. The body can comprise a material that has a density that is greater than a material of the crown, and less than a density of the protruding element.

Preferably, an MOIz of the golf club head is be optimized by an aft-ward placement of the protruding element. The MOIz may have a value that is greater than or equal to 4800 gcm 2.

In further embodiments, the golf club head can generate a sound that is greater than 3600 Hz in response to the ball-striking face impacting a golf ball. Also, a loft of the club head can be greater than or equal to 7 degrees, e.g., preferably, 10 degrees.

A second aspect of the disclosure provides a golf club head that comprises a ball-striking face, crown, sole, and trailing edge. The crown extends back from a top of the ball-striking face, and the sole extends back from a bottom of the ball-striking face. The trailing edge is defined by an aft-most point where the crown meets the sole. When the club head is at address, the trailing edge preferably has a height between about 30% and about 90% of a height of the club head, and more preferably between about 35% and 60%. The club head may include a protruding element coupled to the sole such that a club head CG is within a few millimeters (mm) of an idealized axis passing through a center of, and normal to, the ball-striking face (i.e., the neutral axis). The protruding element may be coupled to an aft portion of the sole. A feature on the protruding element may have a mass selected to position the CG at a low point along and either on or about the neutral axis. For example, the feature may be a weight member on the protruding element, the weight member comprising dense material such as tungsten. Optionally, the crown includes a lightweight material such as graphite, a thermoplastic, or carbon fiber. The crown may have a mass that contributes to positioning the CG close to the neutral axis. For example, the crown may be provided by a separate piece of material (e.g., carbon fiber, prepreg, thermoplastic, or graphite) that is bonded to a body of the golf club head. The skilled artisan will understand that any known mechanism can be used to bond the crown piece to the golf club head's body such as, for example, adhesives, screws, snap fit, or a friction fit. The club head body may include a metal such as titanium. The club head may include a weight member such as a screw coupled the protruding element to locate the club head CG at or close to the neutral axis.

The golf club head may have a loft of at least about ten degrees. Additionally, the golf club head height can be a vertical distance that is defined by horizontal projections of an apex of the crown and the nadir of the sole, when the club is at address. Preferably, the height of the trailing edge has a value that is between about 30% and about 90% of the club head's height. The height of the trailing edge can be selected such that an amount of work required to achieve a golf club swing speed greater than or equal to 100 mph is less than or equal to 6 joules.

In some embodiments, the present disclosure provides a golf club head that includes a body defining an internal cavity. The body includes a crown portion extending along a top side of the body, a sole portion extending along a bottom side of the body, a skirt portion extending along a perimeter of an aft side of the body between the crown portion and the sole portion, and a hosel extending from a heel side of the body. The skirt portion includes a distalmost point along a toe side of the body. The hosel defines a hosel axis that intersects a ground plane at a ground intersection point. The crown portion includes a vertex point adjacent to the hosel that defines vertex height in a direction normal to the ground plane. The vertex height is less than 75% of a maximum height of the body, and a height of the distalmost point in a direction normal to the ground plane is less than 65% of the maximum height of the body.

In some embodiments, the present disclosure provides a golf club head that includes a body defining an internal cavity. The body includes a crown portion extending along a top side of the body, a sole portion extending along a bottom side of the body, a skirt portion extending along a perimeter of an aft side of the body between the crown portion and the sole portion, and a hosel extending from a heel side of the body. The skirt portion includes a distalmost point along a toe side of the body and an aftmost point. A parting line is defined as an imaginary line connecting the distalmost point along the toe side and the aftmost point. The hosel defines a hosel axis that intersects a ground plane at a ground intersection point. The parting line extends downward in a direction toward the ground plane to define a parting line slope or grade of less than 10%.

In some embodiments, the present disclosure provides a golf club head that includes a body defining an internal cavity. The body includes a crown portion extending along a top side of the body, a sole portion extending along a bottom side of the body, a skirt portion extending along a perimeter of an aft side of the body between the crown portion and the sole portion, and a hosel extending from a heel side of the body. The hosel defines a hosel axis that intersects a ground plane at a ground intersection point. The body defines a half-head height that is half of a maximum height of the body defined in a direction normal to the ground plane. The body defines a maximum area plane that defines a maximum cross-sectional area of the body taken in a plane parallel to the ground plane. The maximum area plane is located at a height defined in a direction normal to the ground plane. A difference between the height of the maximum area plane and the half-head height is less than plus or minus 10% of the half-head height.

In some embodiments, the present disclosure provides a golf club head that includes a body defining an internal cavity. The body includes a crown portion extending along a top side of the body, a sole portion extending along a bottom side of the body, a skirt portion extending along a perimeter of an aft side of the body between the crown portion and the sole portion, and a hosel extending from a heel side of the body. The hosel defines a hosel axis that intersects a ground plane at a ground intersection point. When the body is partitioned into eighteen cross sections, each being arranged perpendicular to the ground plane, that are evenly spaced along a length of the body in a heel-toe direction so that a first cross section is arranged adjacent to the toe side and the eighteenth cross section is arranged adjacent to the heel side, an average value of a toe height coordinate, measured in a direction normal to the ground plane, of a centroid defined by the first cross section, a second cross section, and a third cross section is less than 41 millimeters. Further, an average value of a heel height coordinate, measured in a direction normal to the ground plane, of a centroid defined by a fourteenth cross section, a fifteenth cross section, and a sixteenth cross section is less than 40 millimeters. Still further, an average value of a cross-sectional area defined by an eighth cross section, a ninth cross section, and a tenth cross section is greater than 5700 square millimeters.

In some embodiments, the present disclosure provides a golf club head that includes a body defining an internal cavity. The body includes a crown portion extending along a top side of the body, a sole portion extending along a bottom side of the body, a skirt portion extending along a perimeter of an aft side of the body between the crown portion and the sole portion, and a hosel extending from a heel side of the body. The hosel defines a hosel axis that intersects a ground plane at a ground intersection point. When the body is partitioned into eighteen cross sections, each being arranged perpendicular to the ground plane, that are evenly spaced along a length of the body in a heel-toe direction so that a first cross section is arranged adjacent to the toe side and the eighteenth cross section is arranged adjacent to the heel side, a ratio of an average cross-sectional area defined by an eighth cross section, a ninth cross section, and a tenth cross section to an average cross-sectional area defined by a fourteenth cross section, a fifteenth cross section, and a sixteenth cross section is greater than 2.9.

Other aspects of the golf club head or portions of the golf club head described herein, including features and advantages thereof, will become apparent to one of ordinary skill in the art upon examination of the figures and detailed description herein. Therefore, all such aspects of the golf club head are intended to be included in the detailed description and this summary.

DETAILED DESCRIPTION OF THE DRAWINGS

Figure 1:
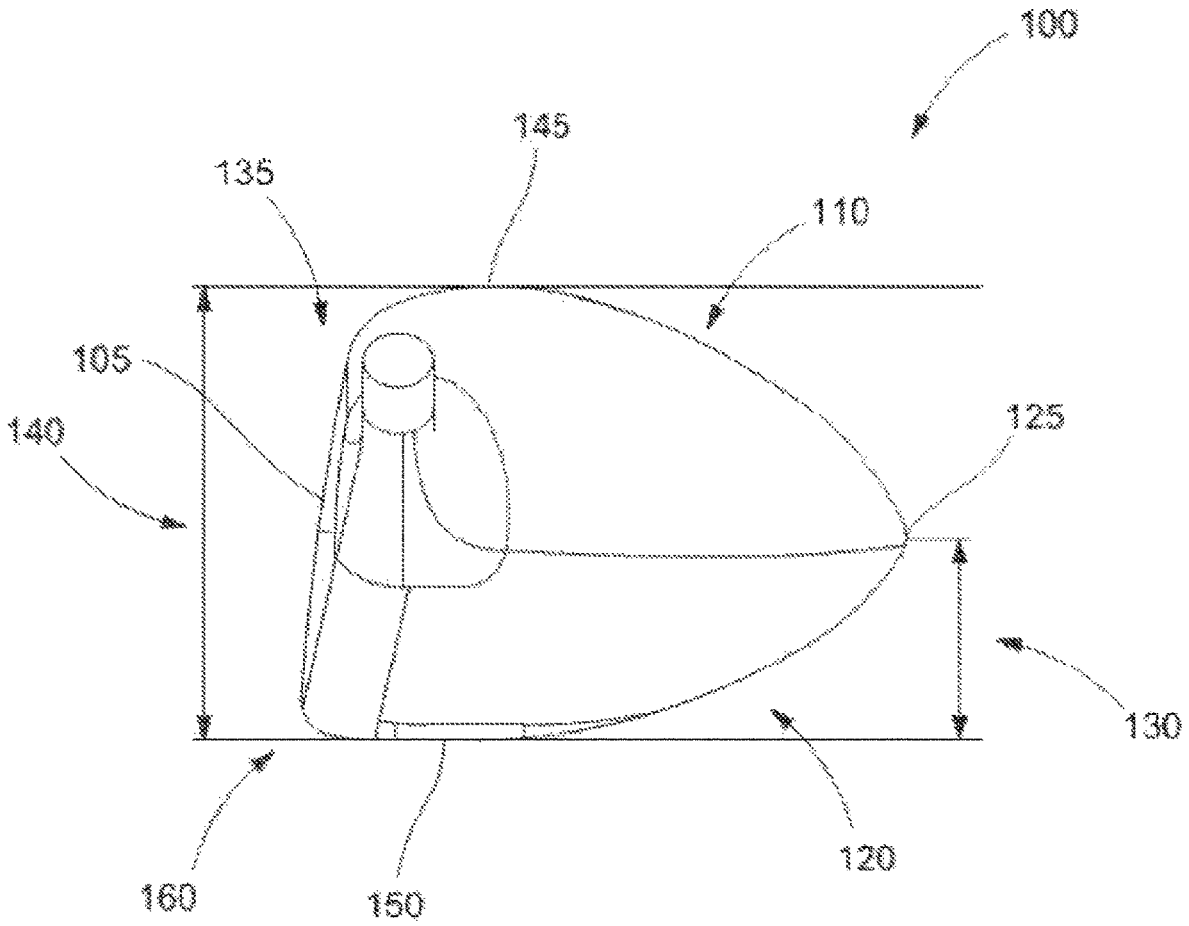
FIG. 1 is a left side view of a golf club head according to an embodiment of the present disclosure.

The following discussion and accompanying figures disclose various embodiments or configurations of a golf club head. Although embodiments are disclosed with reference to a wood-type golf club, such as a driver, concepts associated with embodiments of the wood-type golf club may be applied to a wide range of golf clubs. For example, embodiments disclosed herein may be applied to a number of golf clubs including hybrid clubs, iron-type golf clubs, utility-type golf clubs, and the like. Example golf club and golf club head structures in accordance with this disclosure may relate to "wood-type" golf clubs and golf club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods," e.g., "metal woods" or "fairway woods." Alternatively, golf club and golf club head structures of the disclosure may relate to "iron-type" golf clubs and golf club heads.

The term "about," as used herein, refers to variation in the numerical quantity that may occur, for example, through typical measuring and manufacturing procedures used for golf club heads; through inadvertent error in these procedures; through differences in the manufacture, source, or purity of the ingredients used to make the golf club heads or carry out the methods; and the like. Throughout the disclosure, the terms "about" and "approximately" refer to a range of values±5% of the numeric value that the term precedes.

One factor used in aerodynamics to characterize properties of flow of air around a club head is drag, which adversely affects the velocity profile of the club head. Thus, club head designs that lower the drag during golf swings provide better aerodynamics.

Provided herein are golf club head designs having a trailing edge height that reduces drag during a golf swing compared to existing club heads. To offset any raise in club head CG location, the club heads can be weight balanced using features such as a protruding element bearing a weight member or material selection such as lightweight composites or graphite for the crown. By such means, a club head CG is preferably very close to (within<2 mm of) a neutral axis of the club head. Additionally, positioning a weight member very near the aft of the club head provides the club head with a high MOIz, such that the club head is forgiving to off-center hits.

Advantageously, a raised trailing edge reduces drag on the club head by as much as 40% or even more during a golf swing and, consequently, reduces the amount of work required to move the club head through the air. Using a golf club fitted with a club head of the present disclosure, the club head can achieve swing speeds of 100 mph or greater, with work input of less than six Joules of energy. Thus, the club heads of the present invention display improved aerodynamic properties with maximum energy transfer characteristics that lead to faster swinging and longer, more consistent shots for golfers.

FIG. 1 is a side-view of a golf club head 100 with a raised trailing edge 125. The club head 100 includes a ball-striking face 105, a crown 110 that extends back from a top portion 135 of the ball-striking face 105, and a sole 120 extending back from a bottom portion 160 of the ball-striking face 105. The golf club head 100 further comprises a trailing edge 125 that is defined by a meeting of the crown 110 and the sole 120 at an aft section of the golf club head 100. The aft section is an area of the golf club head 100 that is distal from the ball-striking face 105. The trailing edge 125 has a height 130, as defined when the club head is at address, which is selected to reduce the drag experience by the club head 100.

The trailing edge 125 has a height 130 that is a function of the golf club head's height 140, which can also be defined as a vertical distance between horizontal projections of the crown's apex 145 and the sole's nadir 150. The apex 145 is the highest point of the club head 100, and the nadir 150 is the lowest point of the club head 100. Adjustments of the trailing edge height 130 with respect to the club head height 140 can reduce drag by almost 40%, and, as such, an amount of work to, e.g., less than or equal to 6 joules, required from a golfer to swing the golf club head through the air and reach club head speeds that are greater than or equal to 100 mph. Thus, a golfer, applying an amount of work to the club head designs disclosed herein that is substantially similar to that work applied to other club head designs, is able to achieve faster club head speeds with any one of the club head designs disclosed herein. The faster club head speeds allow the golfer to achieve longer golf shots.

The raised trailing edge 125 may raise the location of a club head CG. The present disclosure includes features and methods for positioning the club head CG in an optimal location, preferably within 2 mm of a neutral axis of the club head, where a neutral axis is an idealized axis passing through a center of, and normal to, the ball-striking face 105.

Figure 2:
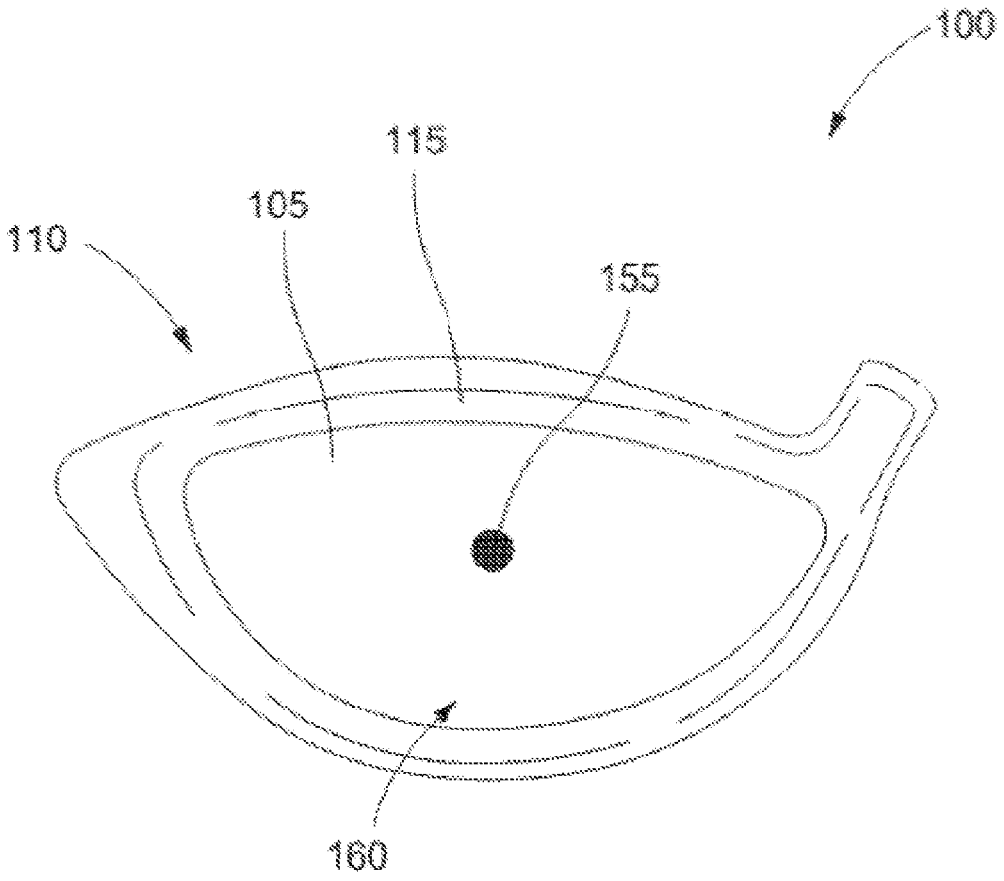
FIG. 2 is a front-view of the golf club head of FIG. 1.

FIG. 2 is a front-view of the golf club head 100, showing a center point 155 of the ball striking face 105. The ball-striking face 105 comprises a center point 155 at which energy transfer of an impact of a golf ball is maximized.

Club heads of the present disclosure feature trailing edge height that reduces drag during a golf swing compared to existing, prior art club heads.

Figure 3:
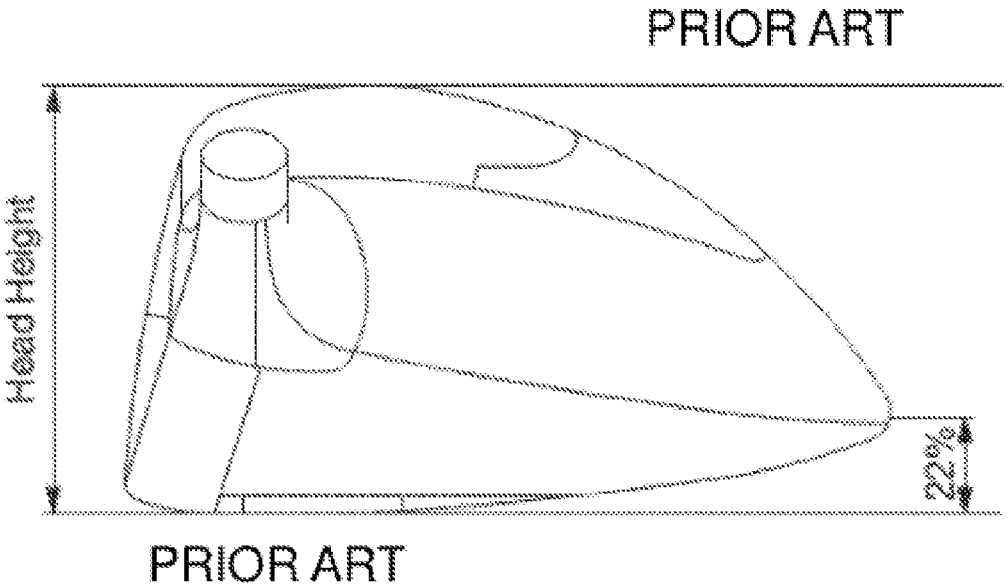
FIG. 3 illustrates a prior art golf club head with a low trailing edge.

FIG. 3 illustrates a prior art club head with a low trailing edge, the trailing edge height being about 22% of the head height as measured when the club is at address. Existing, prior art club heads may have trailing edge heights between about 17% and 30% when so measured. Golf club heads of the present disclosure have a trailing edge height higher than found in prior art club heads.

Figure 4:
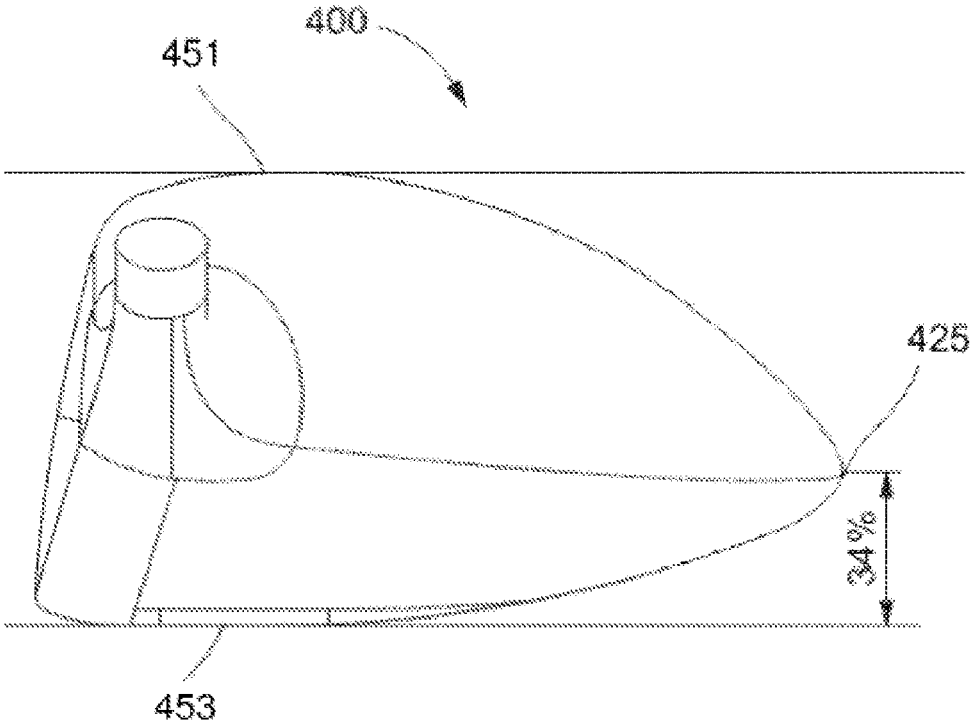
FIG. 4 is a left side view of a golf club head with a mid-height trailing edge according to an embodiment of the present disclosure.

FIG. 4 shows a club head 400 with a mid-height trailing edge 425 of about 34% of a height of the club head 400 as measured from apex 451 to nadir 453, when the club head 400 is at address. The club head 400 has a volume of about 459 cc and requires about 5.8 Joules of work to swing to 100 mph.

Figure 5:
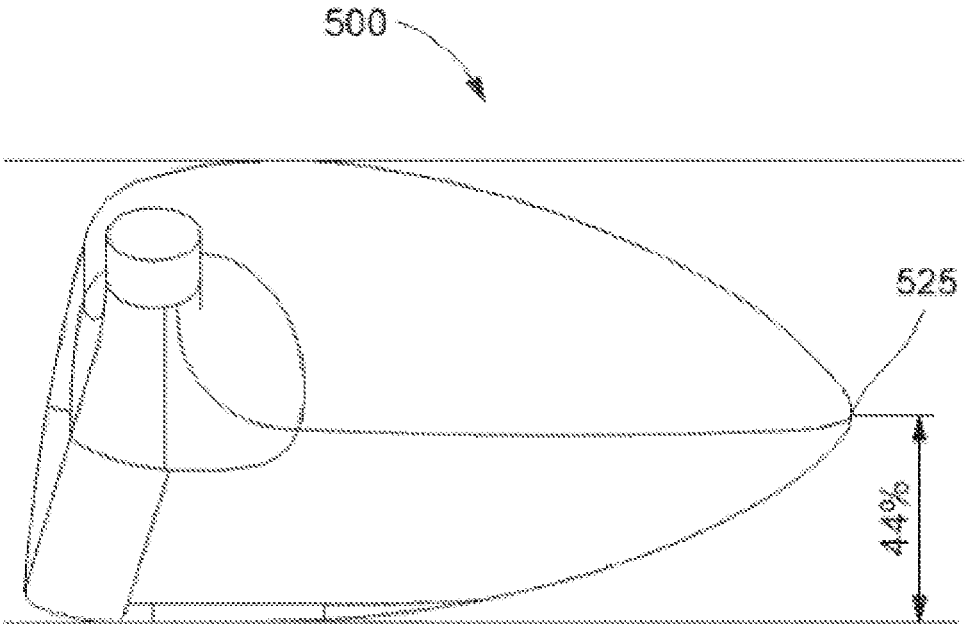
FIG. 5 is a left side view of a golf club head with a high trailing edge according to an embodiment of the present disclosure.

FIG. 5 shows a club head 500 with a high trailing edge 525 of about 44%. The club head 500 has a volume of about 459 cc and requires about 5.5 Joules of work to swing to 100 mph.

Figure 6:
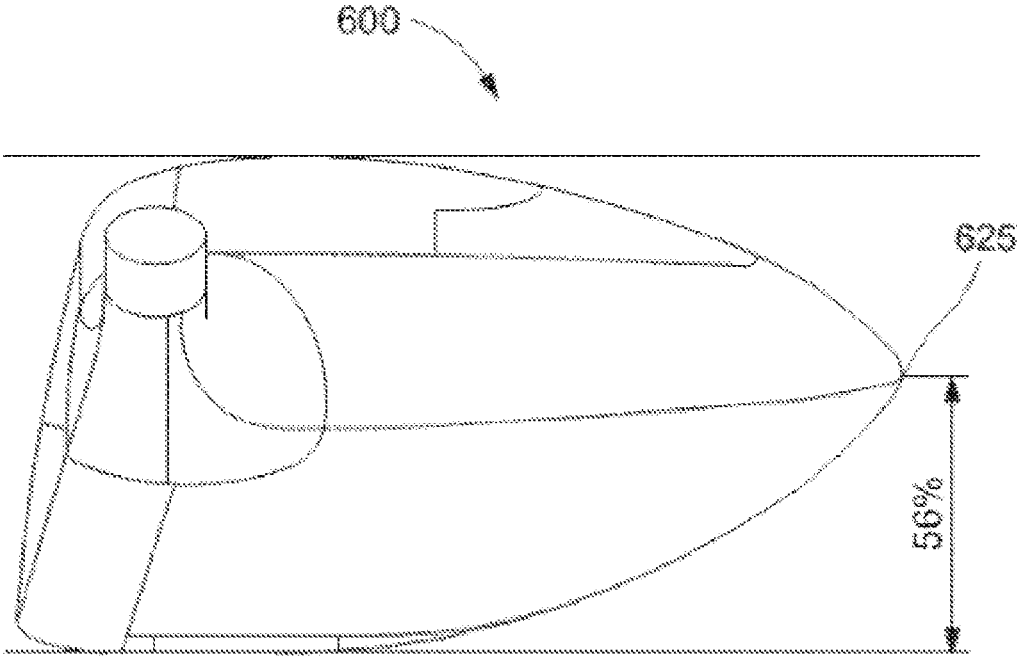
FIG. 6 is a left side view of a golf club head with a very high trailing edge according to an embodiment of the present disclosure.

FIG. 6 shows a club head 600 with a very high trailing edge 625 of about 56%. The club head 600 has a volume of about 459 cc and requires about 4.8 Joules of work to swing to 100 mph.

The raised trailing edge (compared to prior art club heads) of club heads 400, 500, 600 decreases drag on the club heads and an associated amount of required work for achieving speeds greater than or equal to 100 mph. Trailing edge height 425 is 34% of a height of club head 400 (i.e., a 22% TE/CH ratio) and requires approximately 5.8 joules (J) of work to achieve club head speeds greater than 100 mph. To offset any effect on CG of a raised trailing edge, the club heads 400, 500, 600 may include features that position the club head CG in an optimal location, preferably within 2 mm of a neutral axis of the club head, where a neutral axis is an idealized axis passing through a center of, and normal to, the ball-striking face 105.

Figure 7:
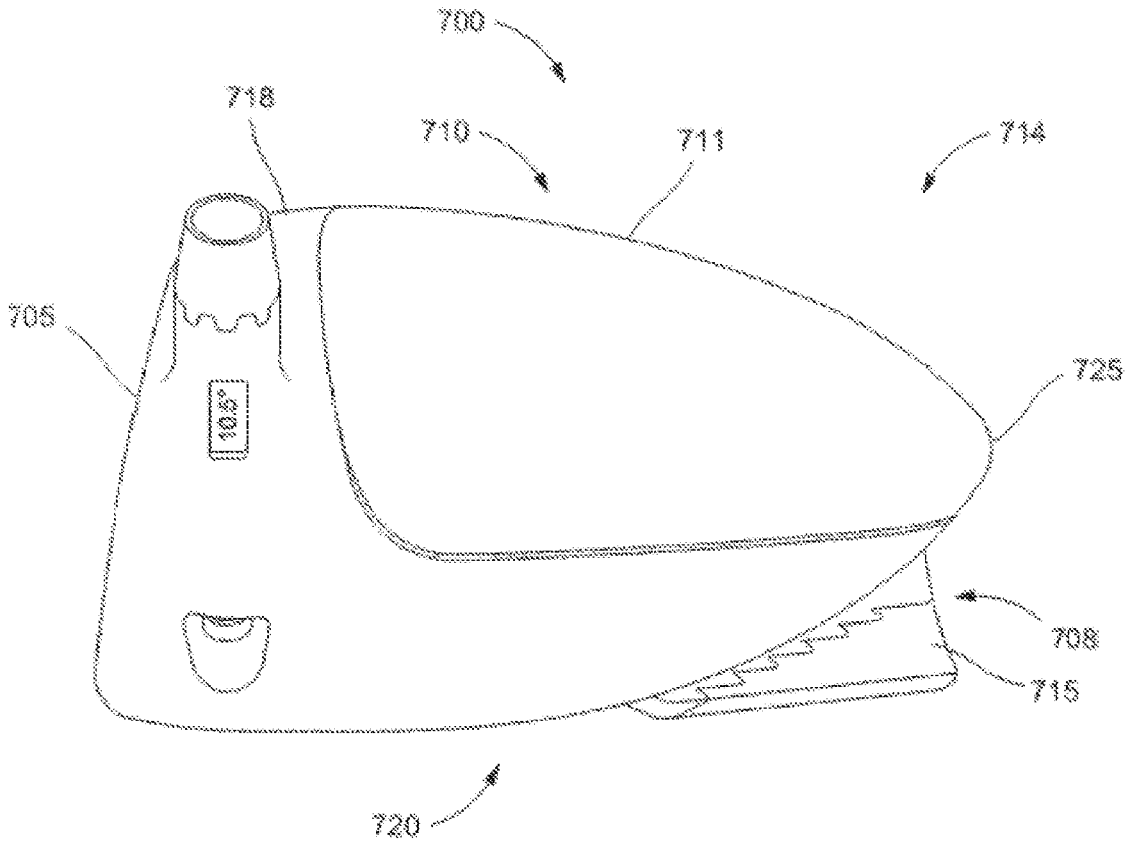
FIG. 7 is a left side view of a golf club head with a protruding element and a weight member according to an embodiment of the present disclosure.

FIG. 7 is a side view of a club head 700 with a protruding element 708 with a weight member 715. The club head 700 includes a ball-striking face 705 with a crown 710 and a sole 720 extending back from the ball-striking face 705 and meeting at a trailing edge 725 to define an enclosed, hollow club head body 714 having an internal cavity 716 (see FIG. 8). The club head 700 may optionally employ a multi component construction in which a first body member 718 provides substantial portions of the sole 720 and the ball-striking face, and in which a crown piece 711 provides a substantial portion of the crown 711.

Figure 8:
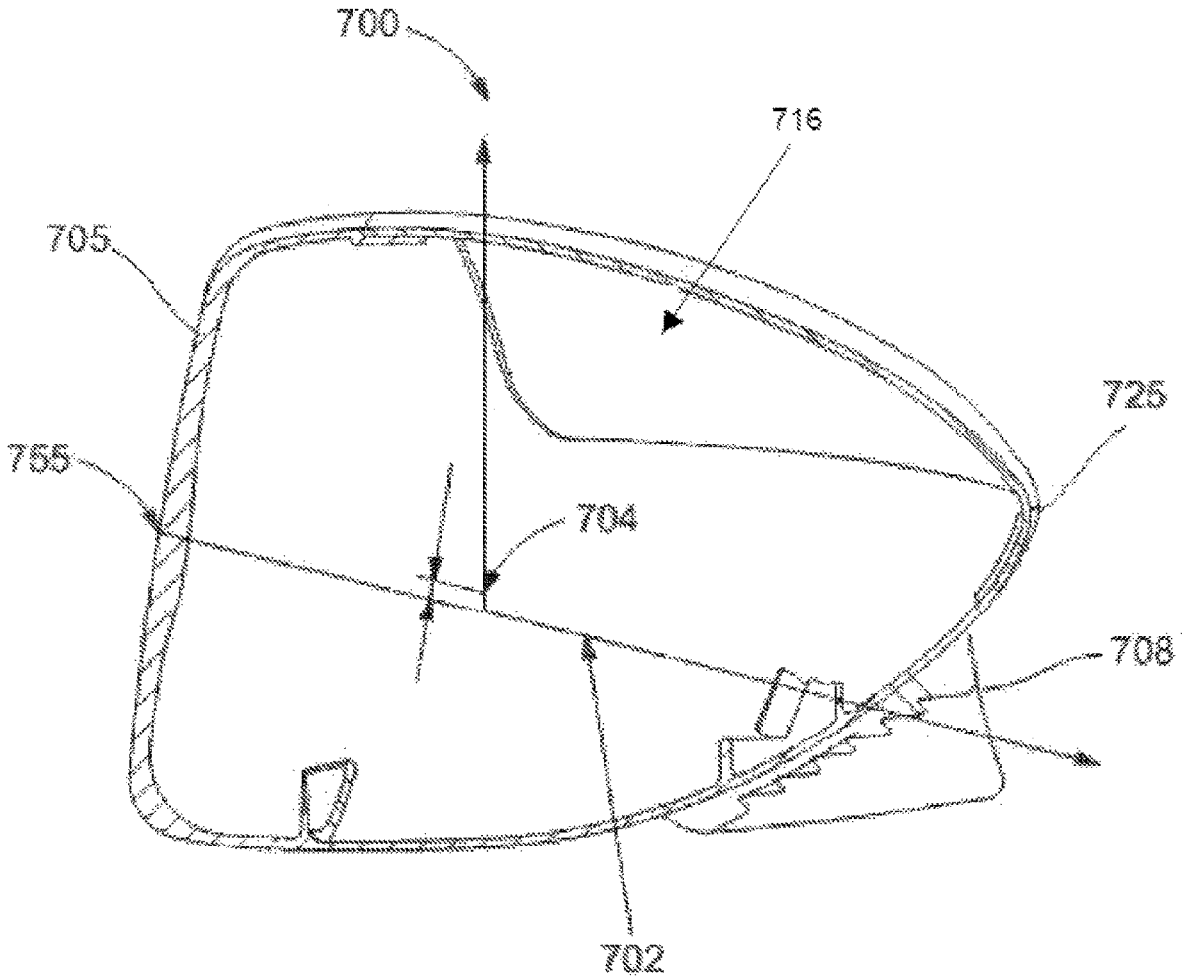
FIG. 8 is a cross-sectional view of the golf club head of FIG. 7.

FIG. 8 is a cross-section through the club head 700 with the protruding element 708 and the raised trailing edge 725. As shown, a club head CG 704 is located about 1.9 mm from a neutral axis 702 of the club head 700. The club head CG 704 can be defined by a vertical location (how high up the CG is from the sole), horizontal location (how far it is from the center of a club head's shaft in a hosel (not shown) of the head), and depth (how far back from the ball striking face 705). In other examples, the CG can be defined based on horizontal/vertical locations with respect to a surface of the ball-striking face 705, and its depth into the club head 700 with respect to the face 705.

Ideally, the CG 704 should be positioned along and either on or about, e.g., within a few millimeters, the club head's neutral axis 702 for efficient energy transfer and to maximize its MOL This neutral axis is normal to and passing through a center point 755 of the ball-striking face 705. For example, the neutral axis 702 is perpendicular to a surface (e.g., geometric plane) defined by the ball-striking face 705 and normal to a center 755 of the ball-striking face 705. The center 755 is a point of intersection of the face's 755 longest vertical and horizontal axes (not shown). This center point 755 can also define a point of origin for a vector of the neutral axis 702 which runs through the club head 700. The axes described herein are not physical components of the club head 700, and are idealized constructs used to aid in understanding the relationships among the depicted elements.

As illustrated, the CG 704 is located at a point that is a distance from the neutral axis 702, wherein the distance is preferably no more than about 7 mm, and more preferably no more than about 2 mm. Locating the club head CG 704 at most 7 millimeters (mm) away, at most 2 mm away, or between 2 mm and 7 mm from the neutral axis 704 maximizes energy transfer to a ball at impact.

Figure 9:
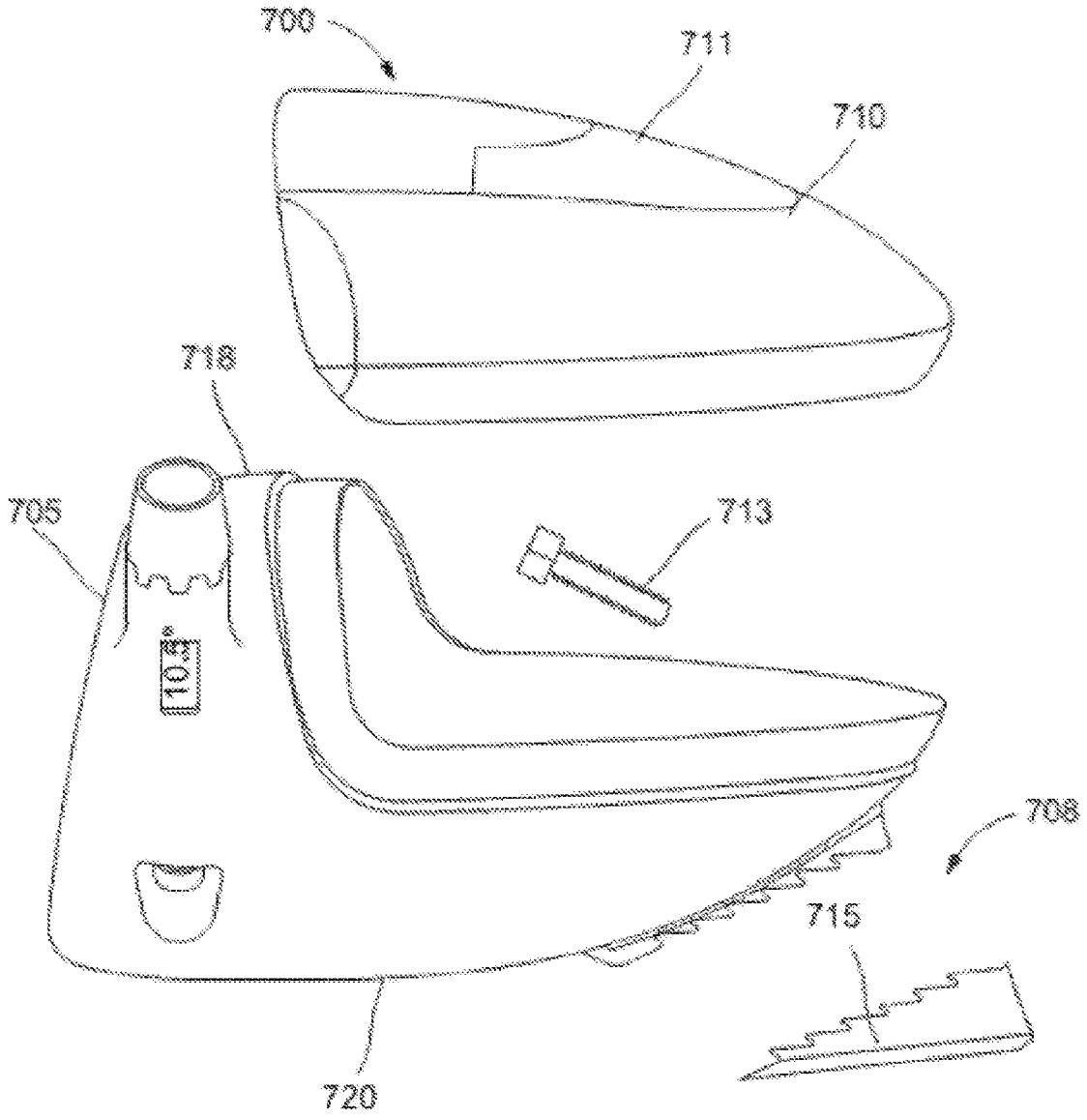
FIG. 9 is an exploded view of the golf club head of FIG. 7.

FIG. 9 is an exploded assembly view of a club head 700. In the depicted embodiment, the club head 700 uses a multi-component construction in which a first body member 718 provides substantial portions of the sole 720 and the ball-striking face, and in which a crown piece 711 provides a substantial portion of the crown 710. Preferably, the body member 718 comprises a first material and the crown piece 711 comprises a second material. Part or all of the protruding element 708 may include a third material. For example, a portion of the protruding element 708 may be provided as a weight member 715 made of the third material. The weight member 715 may be coupled to the body member 718 via a screw 713, which itself may be mass-optimized or weighted through the use of a fourth material.

In certain embodiments, the first material used for the body member 718 is a metal alloy such as titanium, aluminum, or stainless steel. The second material used for the crown piece 711 is a plastic or composite (e.g., carbon fiber or graphite). The third material used for the weight member 715 is a material (e.g., lead or tungsten) having a density (e.g., about or greater than 11.34 g/cm 3) greater than the first and second materials. The fourth material, for the screw 713, may be a metal or metal alloy such as stainless steel, lead, and tungsten. The weight of each of the first, second, third, fourth materials is selected to position the club head CG 704 at a position that maximizes the efficiency of the club head's transfer of energy to a golf ball at impact with the club head's ball-striking face 705.

In preferred embodiments, the crown piece 711 is bonded to the body member 718 and the protruding element 708 is coupled to an aft section of the sole 720. The skilled artisan will understand that any known mechanism can be used to bond the crown piece 711 to the body member 718. For example, any fastening means such as the use of adhesive, screw(s), snap fit means, and friction fit means can be used to bond the crown piece 711 to the body member 718. See U.S. Pub. 2017/0189770; U.S. Pub. 2012/0172147; U.S. Pat. No. 9,504,889; U.S. Pub. 2013/0178306; U.S. Pub. 2013/0178305; U.S. Pat. Nos. 6,969,326; 7,431,664; 7,361,100; U.S. Pub. 2007/0155533; U.S. Pub. 2004/0116207; and U.S. Pub. 2017/0001082, each incorporated by reference. Additionally, the weight member 715 of the protruding element 708 can be coupled to the sole 720 using a screw 713, which can be weighted to further optimize the club head's CG (e.g., the CG 704 of FIG. 7). The protruding element 708 can also be coupled to the sole 720 by any other means. For example, the skilled artisan also understands that the protruding element 708 can be coupled using any coupling means such as a sleeve fit, male/female interfaces, shaft coupling, snap fit means, and friction fit means.

Any suitable protruding member may be included to optimize a mass distribution of a club head of the disclosure; other embodiments are within the scope of the disclosure.

Figure 10:
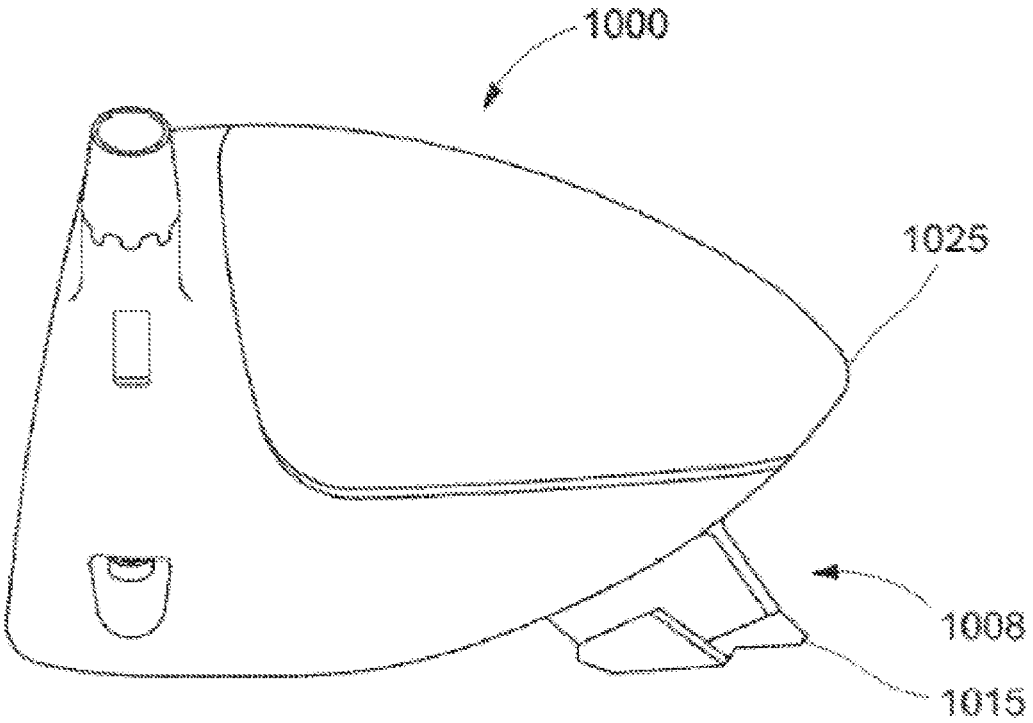
FIG. 10 is a left side view of a golf club head with a protruding element having a low CG weight member according to an embodiment of the present disclosure.

FIG. 10 shows a club head 1000 with a low protruding element 1008, which has a low CG weight member 1015, extending below the high trailing edge 1025.

Figure 11:
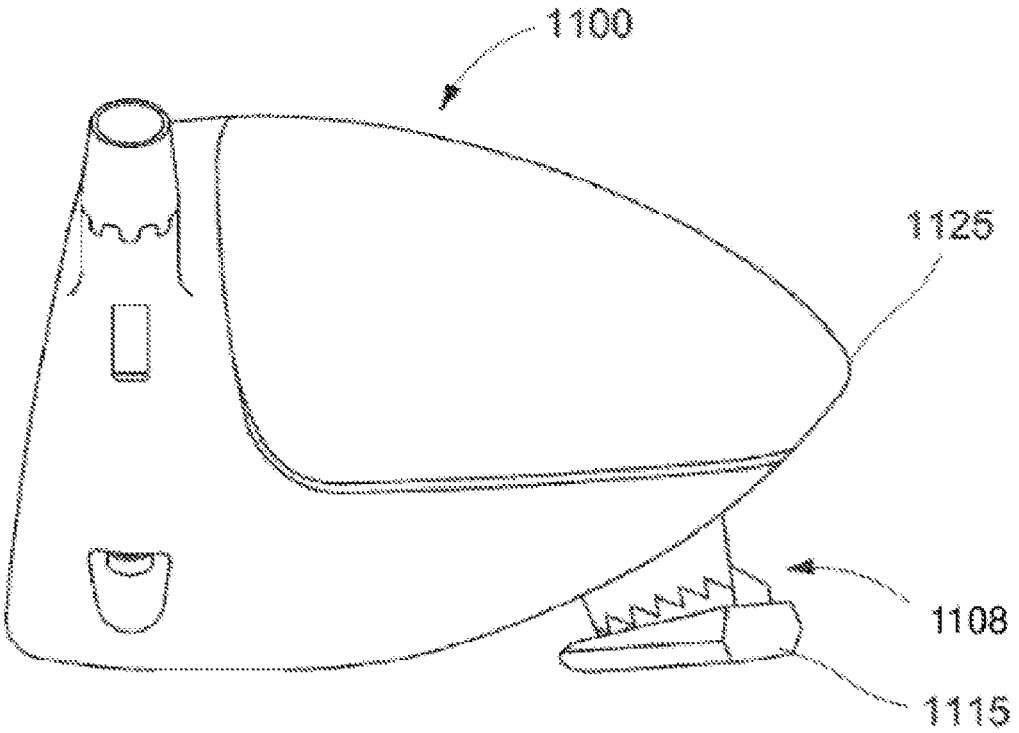
FIG. 11 is a left side view of a golf club head with a foot-style protruding element according to an embodiment of the present disclosure.

FIG. 11 shows a club head 1100 with a foot-style protruding element 1108, with a wide weight member 1115 positioned beneath a raised trailing edge 1125.

Club heads of the disclosure are designed with a trailing edge positioned at a height that minimizes drag during a golf swing, resulting in faster swing speeds. To offset any potential effect that the raised trailing edge may have on a location of the club head CG, the club heads may include a weighted protruding element extending from a sole of the club head. The club head aerodynamics are influenced by the height of the trailing edge and by a configuration of the protruding element. The protruding element may have an aerodynamic design to minimize drag on the club head during a golf swing. Aerodynamic models may show that club heads of the disclosure exhibit lower drag than prior art club heads.

Figure 12:
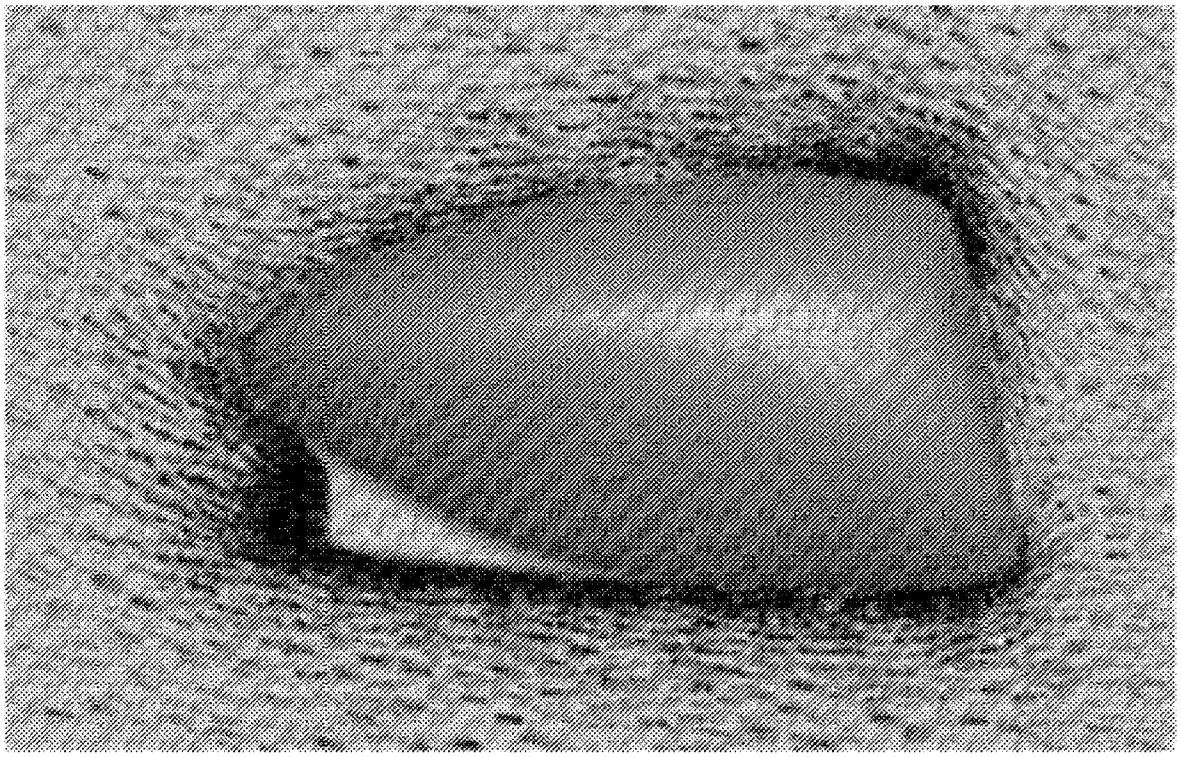
FIG. 12 illustrates aerodynamics of a golf club head of the present disclosure.

FIG. 12 illustrates aerodynamics of a golf club of the present disclosure. An analysis was performed using Computational Fluid Dynamics (CFD) to validate effects on drag of features of the present disclosure. The CFD analysis shows that drag is reduced in club heads of the disclosure relative to prior art club heads. A Finite Element Analysis (FEA) validates that the energy transfer from the club head into a golf ball is optimized by the mass distribution of club heads of the disclosure.

By raising the trailing edge of the crown surface, club heads of the disclosure reduce drag force on the driver over a substantial portion of the swing and consequently reduce the amount of work to move the driver through the air, along a swing path, by almost 40%. Such improvements provide measurable performance in club head speed gains. Knowing the launch conditions have been compromised by the higher CG location, an effort has been made to keep the good aerodynamic design of the raised trailing edge combined with a desirable low CG location through the addition of an external weight on the sole of the club head to obtain high performance ball launch conditions. This creates a golf club delivering more kinetic energy to the ball due to a faster club head speed producing higher balls speeds and both high performance launch conditions from the relatively low CG position. Club heads of the disclosure add weight low (closer to the ground) and aft (further from the face) on the club head to achieve the optimal CG position with high MOI values. Club heads of the disclosure recognize restrictions in USGA driver volume, optimal head weight targets, and aerodynamic tendencies. Thus an optimal design is provided through the usage of very dissimilar materials positioned where their inherent strengths and properties yield a club head with unprecedented aerodynamic properties combined with highly desired mechanical properties (CG & MOIz). Club heads of the disclosure are faster when swung when compared to prior art club heads due to the low drag design of club heads of the disclosure. In addition, the transfer of energy from the faster moving club heads of the disclosure is received by the golf ball due to the optimally positioned CG and high MOI values. This efficient transfer of energy to the golf ball enables the golf ball to travel farther than with prior art head designs, everything else being equal. The present disclosure provides club heads that aggressively reduce air drag along a swing path with a highly engineered hitting face for golfers of all abilities to feel confident in making a full and fast swing into the ball.

Club heads of the disclosure have a shape that delays flow separation on the club head swing throughout the swing. Every surface of the driver has been engineered to help reduce aerodynamic drag throughout the swing path. Club heads of the disclosure have a pleasing sound (>3600 Hz) at impact and a design that positions club head CG at an optimal location for excellent energy transfer into the golf ball. This is achieved by positioning the CG very close to an axis perpendicular to the center of the face, running through the club head (i.e., the neutral axis). This is accomplished by using a larger than usual crown piece of a material such as graphite composite which replaces heavier titanium in the uppermost areas of the club head thereby pushing the CG lower in the club head.

In addition, a very dense weight member of a material such as tungsten is pendant from the sole and towards the aft of the club head to further lower the club head CG and to increase the club head's inertial properties to help reduce club head twisting on miss-hits to help transfer the kinetic energy of the club head more fully into the golf ball. The club head construction of a large, lightweight crown (e.g., graphite composite), bonded to a denser body member (e.g., titanium), and a heavy weight member (e.g., tungsten) affixed low on the head, makes for a low CG, high MOI driver coupled with the lowest drag body design on the market.

Club heads of the disclosure are improved over prior art club heads due to measurable aerodynamic improvements and the use of various materials to locate CG such that the club heads deliver head speed energy more effectively into the golf ball for increased ball velocity, desired launch angle, and lower backspin to obtain longer shots.

Figure 13:
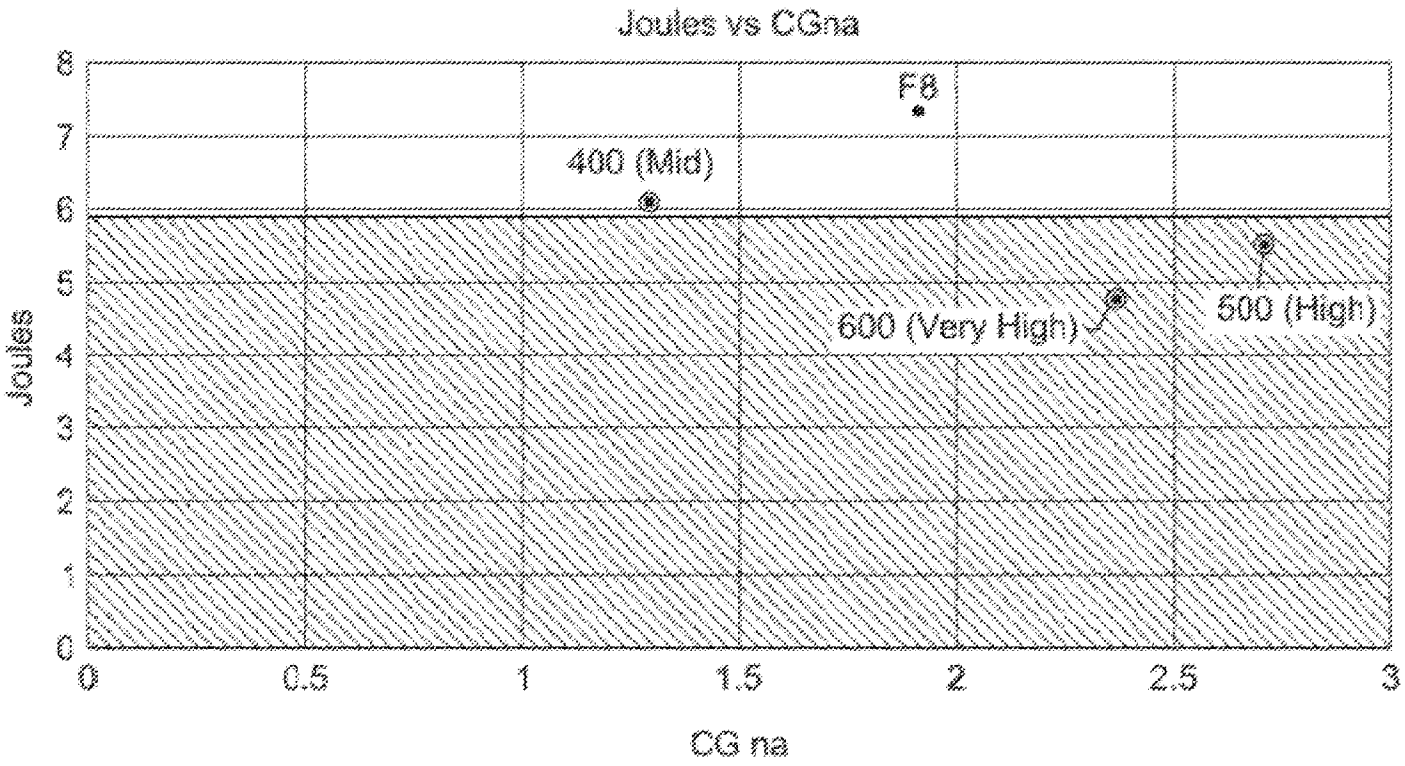
FIG. 13 is a graph of work required in Joules to achieve swing speed of 100 mph.

FIG. 13 shows work required in Joules to achieve a swing speed of 100 mph for the club head 400 with a mid-height trailing edge 425, a club head 500 with a high trailing edge 525, and for the club head 600 with a very high trailing edge 625. A relationship between the trailing edge height of club head, club head height, CG position about a neutral axis, and work required due to reduced drag to achieve swing speeds greater than 100 mph is shown for the club head 400 (Mid; 34%), the club head 500 (High; 44%), and the club head 600 (Very High; 56%).

Table 1 shows the relationship between the position of a club head's CG and certain performance characteristics of the club head. As shown in Table 1, the CG is optimally positioned close to the neutral axis at a position that is back and down. However, as a trailing edge is raised with respect to a height of the club head, the CG is moved up. As such, the club head is weighted such that the CG can be positioned lower in the club head (i.e., closer to the neutral axis). As shown in Table 1, an optimal position of the CG can also result in the club head having a higher MOIz value.

TABLE 1

| Performance summary | | |
|---|---|---|
| Performance | CG Forward | CG Back |
| Dynamic Loft | Decreases | Increases |
| Spin | Decreases | Increases |
| Closure Rate | Decreases | Increases |
| MOIz | Decreases | Increases |
| | CG Up | CG Down |
| Dynamic Loft | Decreases | Increases |
| Spin | Increases | Decreases |

The CG is influenced by a weight member of a protruding element, a material of the crown, and a material of a body of the club head.

The weighted protruding element is coupled to an aft section (e.g., at a location away from the ball striking face) of the sole. The protruding element can be made of a dense material such as tungsten, or another material of comparable density, such that a smaller amount of material is needed to optimally position the CG, and such that any drag benefits from raising the trailing edge is not deleteriously affected by the feature. The feature can have any geometry known to have low drag characteristics. For example, the feature may be fin shaped (e.g., similar to a shark's fin), or airplane tail fin shaped. A skilled artisan understands that the feature may have any geometry and shape that minimizes drag. The crown may include a crown piece made of a light-weight material such that upward movement of the CG due to raising the trailing edge is minimized. For example, the crown piece may include graphite composite or any material with similar characteristics. Additionally, the body may include titanium such that the weight does not adversely affect the CG position.

Figure 14:
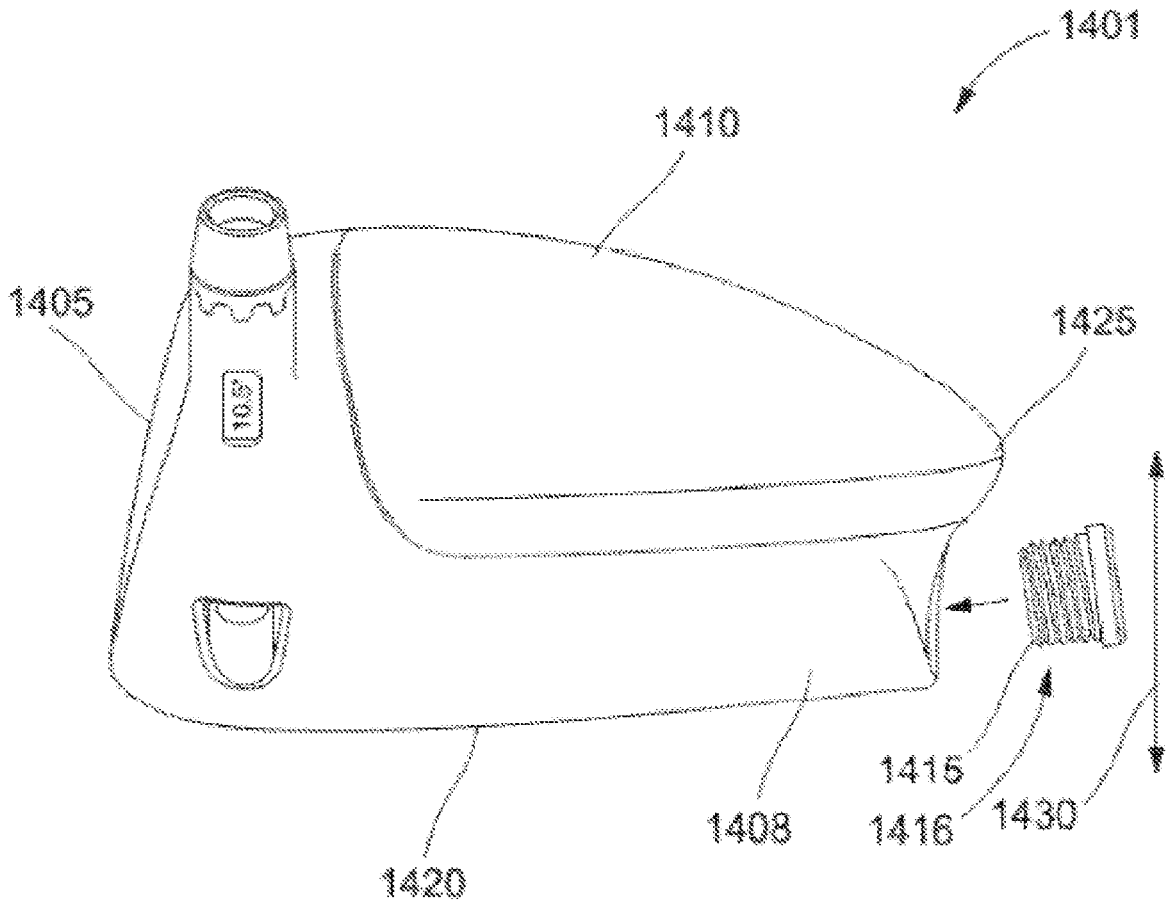
FIG. 14 is a left side view of an aft-weighted golf club head according to an embodiment of the present disclosure.

FIG. 14 shows an aft-weighted golf club head 1401 according to certain embodiments. The aft-weighted golf club head 1401 includes a ball-striking face 1405, a crown 1410 extending back from a top of the ball-striking face, and a sole 1420 extending back from a bottom of the ball-striking face 1405. A trailing edge 1425 is defined by a meeting of the crown 1410 and the sole 1420. A height 1430 of the trailing edge 1425, when the club head 1401 is at address, is selected to reduce drag the golf club head experiences during a golf swing. The golf club head 1401 has a protruding element 1408 as an extension of the sole 1420, as well as a detachable weight member 1415.

Here, the protruding element 1408 is provided as an integral medial ridge that arises from the base sole shape, made from the same, or other lightweight material as the body. This protruding element 1408 may be made in a tangential relationship to the sole surfaces or may diverge in a non-tangential relationship from the base sole surface shape. The protruding element 1408 is tangentially blended into, and allows for smooth transition from, the sole 1420 to allow the airflow that occurs during a swing to more easily pass over the lower portion of the club head with less drag.

Figure 15:
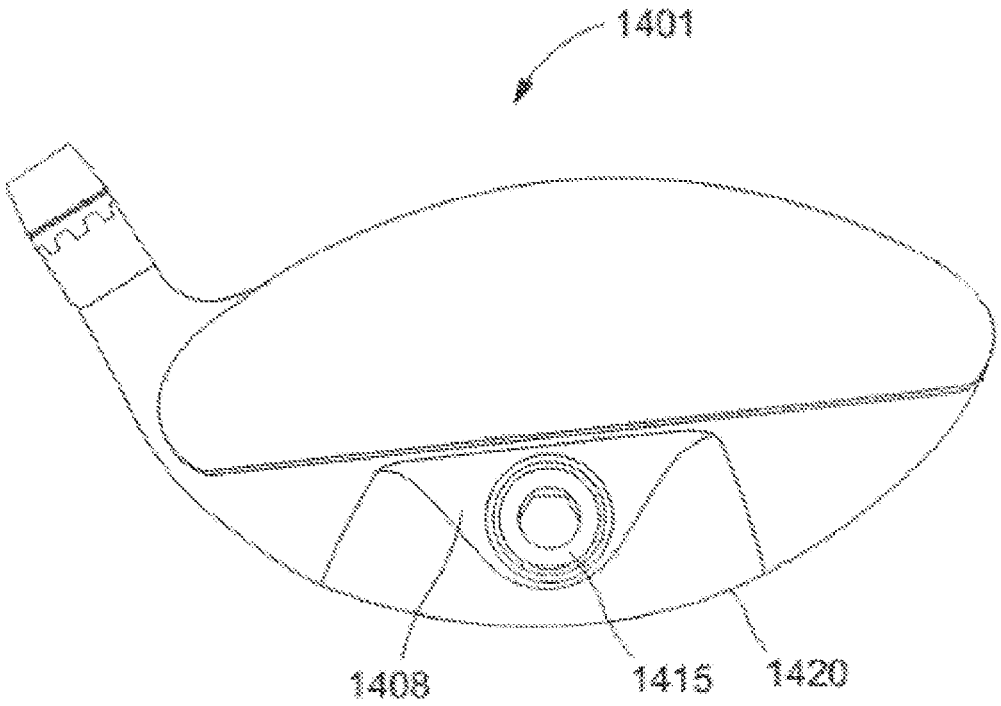
FIG. 15 is a rear or back view of the aft-weighted golf club head of FIG. 14.

FIG. 15 shows a back view of the aft-weighted club head 1401, showing that the protruding element 1408 is an integral medial ridge that arises smoothly from the sole 1420. The protruding element 1408 is designed in a tangential and smooth blending design with the sole 1420 and can receive a weighting member 1415 of a density greater than the body material and more preferably with a density of around 15 g/cm^3 and a weight varying between 20-30 grams. In this embodiment, it is advantageous to more securely hold the weight member 1415 securely in place, e.g., via a long-threaded post 1416, to react the high forces that are exerted on the weight member 1415 during impact with the ball.

Due to the positioning of weight member 1415, the CG is positioned within a few millimeters of an axis normal to and passing through a center point on the ball-striking face 1405.

Figure 16:
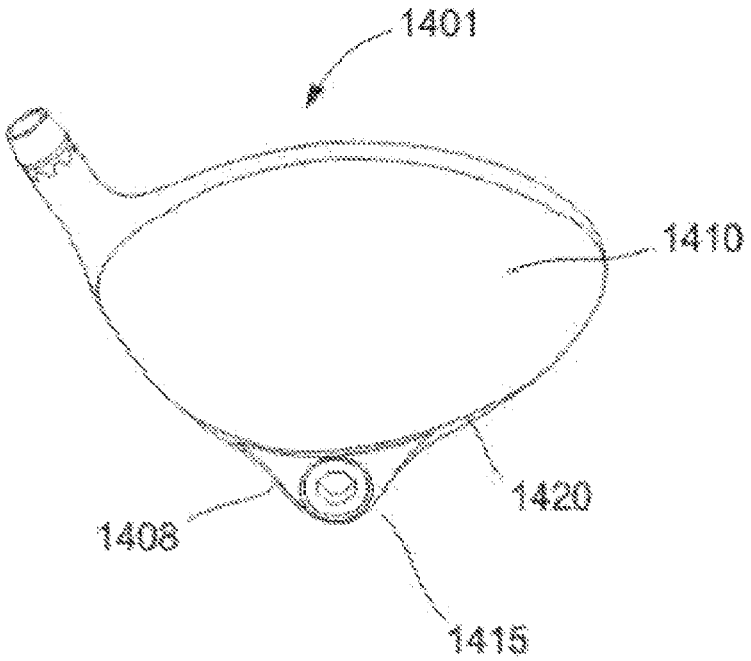
FIG. 16 is a rear perspective view of the aft-weighted golf club head of FIG. 14.

FIG. 16 is a rear perspective view of the aft-weighted club head 1401. It can be seen that the protruding element 1408 extends gently from an aft section of the sole 1420. The weight member 1415 positions the CG at a low point along and either on or about the axis. In certain embodiments of the aft-weighted club head 1401, a portion of the crown 1410 is provided by a crown piece made of a lightweight material such as a composite or thermoplastic. Preferably, at least a portion of the protruding element 1408 (e.g., the weight member 1415) has a density that is about eleven grams per cubic centimeter or greater. The sole 1420 may be provided by a body member of a metallic material such as steel or titanium. A height 1430 of the trailing edge 1425 is between about twenty two percent and fifty six percent of a crown-to-sole height of the golf club head 1401 as defined when the club head is at address. The golf club head 1401 has a moment of inertia through a vertical axis of at least about 4800 gcm 2. Other embodiments are within the scope of the disclosure.

Figure 17:
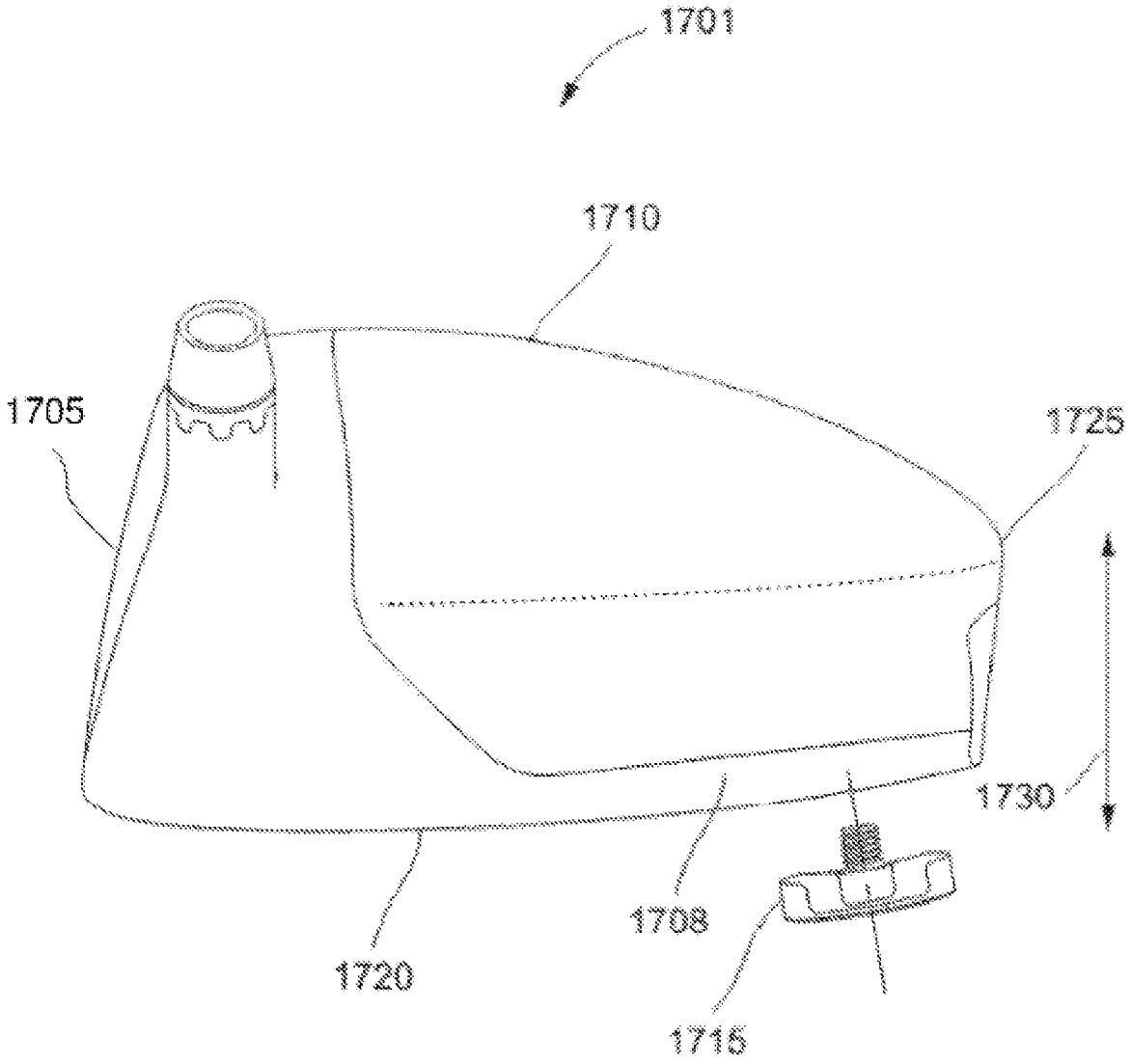
FIG. 17 is a left side view of a weighted aero golf club head according to an embodiment of the present disclosure.

FIG. 17 shows a weighted aero club head 1701 according to some embodiments. The weighted aero club head 1701 includes a ball-striking face 1705 (mislabeled as 1405 in the figures) a crown 1710 extending back from a top of the ball-striking face 1705, a sole 1720 extending back from a bottom of the ball-striking face, and a trailing edge 1725 defined by a meeting of the crown 1710 and the sole 1720. A height 1730 of the trailing edge 1725 when the club head is at address is set to reduce drag that the weighted aero club head 1701 experiences during a golf swing. The weighted aero club head 1701 has a protruding element 1708 pendant from the sole 1720 with a weight member 1715 coupled to the protruding element 1708.

Figure 18:
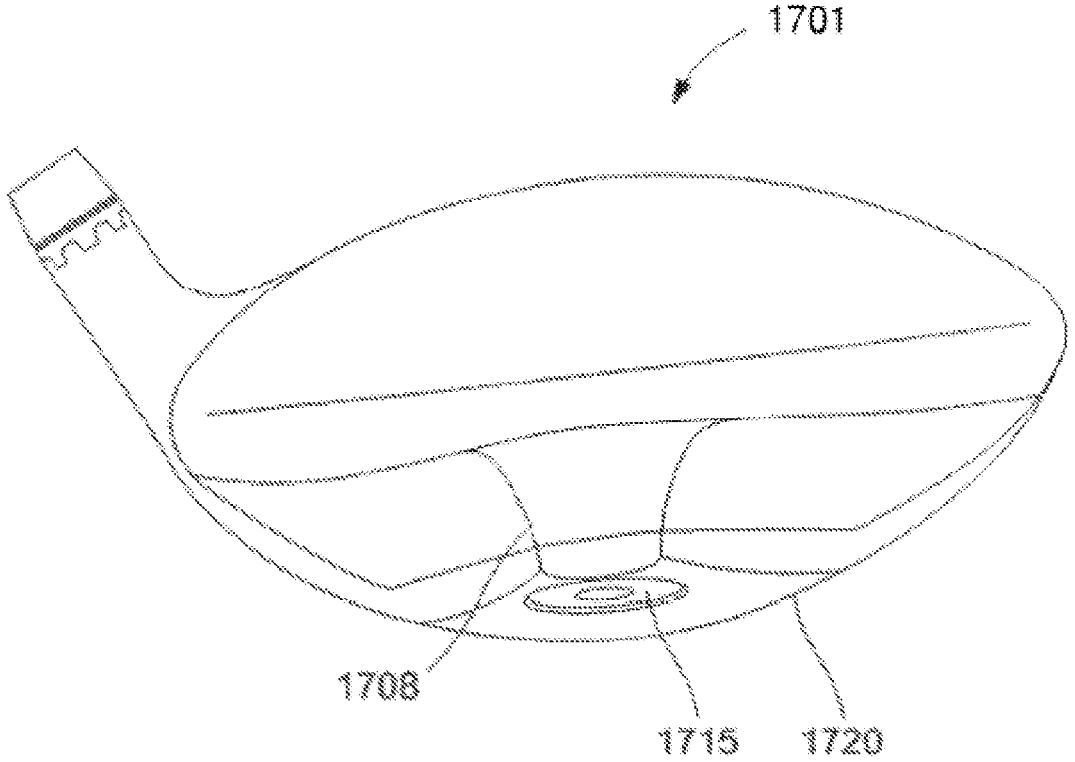
FIG. 18 is a rear or back view of the weighted aero golf club head of FIG. 17.

FIG. 18 is a back view of the weighted aero club head 1701. The protruding element 1708 depends from the sole 1720 as a styled integral shape, which may be made from the same, or other lightweight material as the body. The protruding element 1708 may be made in a tangential relationship to the sole surfaces or may diverge in a non-tangential relationship from the base sole surface shape. It is preferred that the protruding element 1708 is tangentially blended into, and allows for smooth transition from, the sole 1720 to allow any airflow that occurs during the swing to more easily pass over the lower portion of the club head 1701 with less drag. By virtue of the weighted member 1715, the CG is positioned within a few millimeters of an axis normal to and passing through a center point on the ball-striking face 1705.

Figure 19:
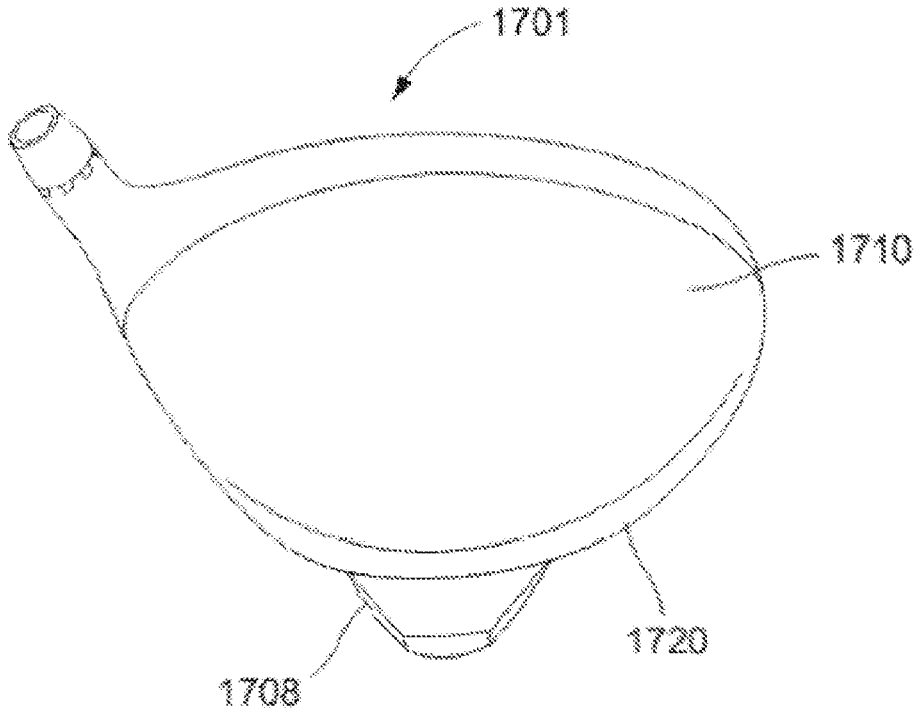
FIG. 19 is a rear perspective view of the weighted aero golf club head of FIG. 17.

FIG. 19 is a rear perspective view of the weighted aero club head 1701 showing the protruding element 1708 pendant from an aft portion of the sole 1720. The weighted member 1715 has a mass that positions the CG at a low point along and either on or about the axis. The height 1730 of the trailing edge 1725 is preferably between about twenty two percent and fifty six percent of a height of the golf club head 1701 when the club head is at address. The golf club head 1701 may have a moment of inertia through a vertical axis of at least about 4800 gcm^2.

Figure 20:
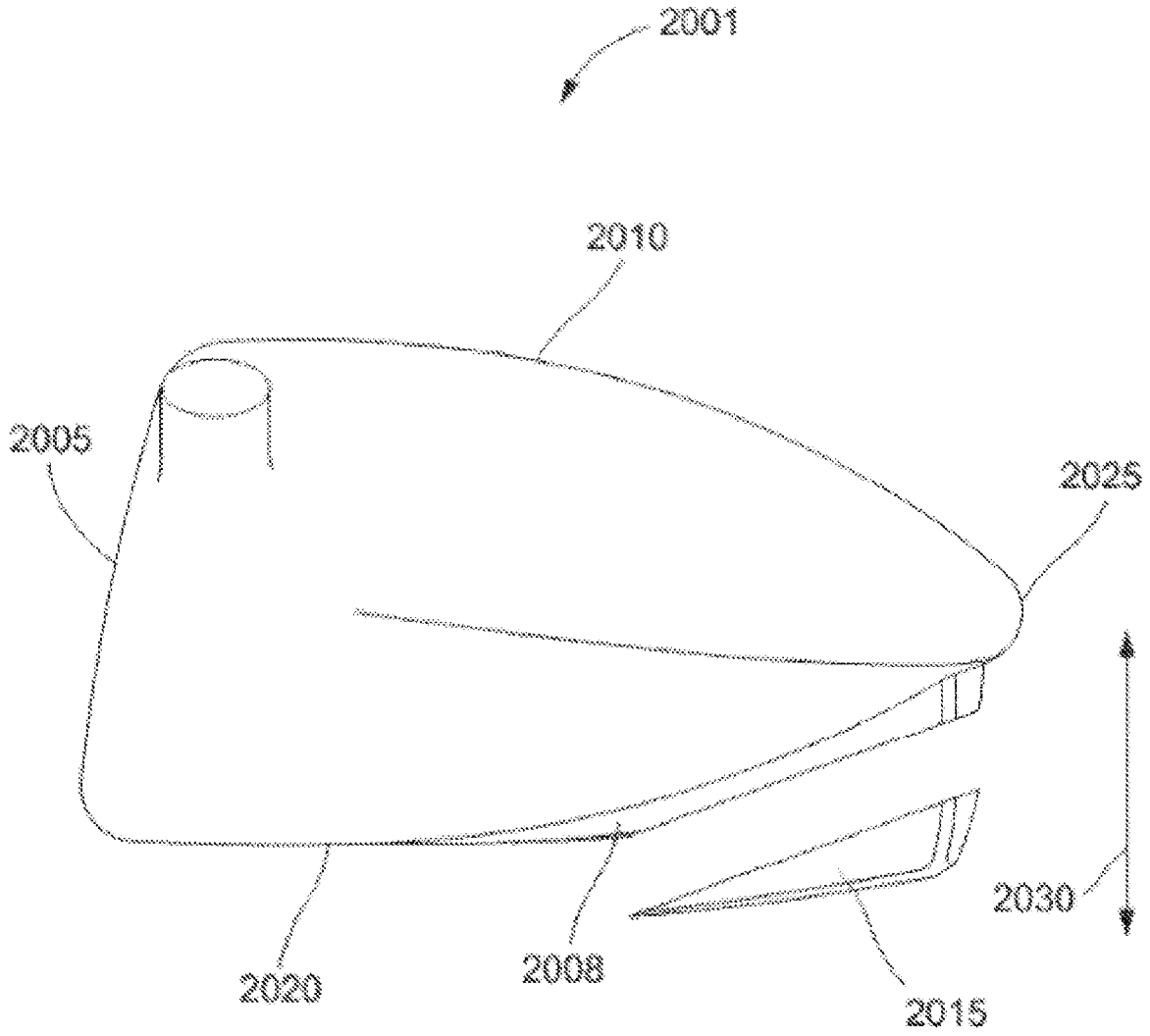
FIG. 20 is a left side view of a ridge-weighted golf club head according to an embodiment of the present disclosure.

FIG. 20 depicts a ridge-weighted club head 2001 according to embodiments. The ridge weighted club head 2001 includes a ball-striking face 2005, a crown 2010 extending back from a top of the ball-striking face, a sole 2020 extending back from a bottom of the ball-striking face 2005, and a trailing edge 2025 defined by a meeting of the crown 2010 and the sole 2020. A height 2030 of the trailing edge 2025 when the club head 2001 is at address reduces drag the golf club head experiences during a golf swing. The ridge-weighted club head 2001 has a protruding element 2008 extending from the sole 2020 and coupled to a weight member 2015 to adjust a position of a club head center of gravity.

Figure 21:
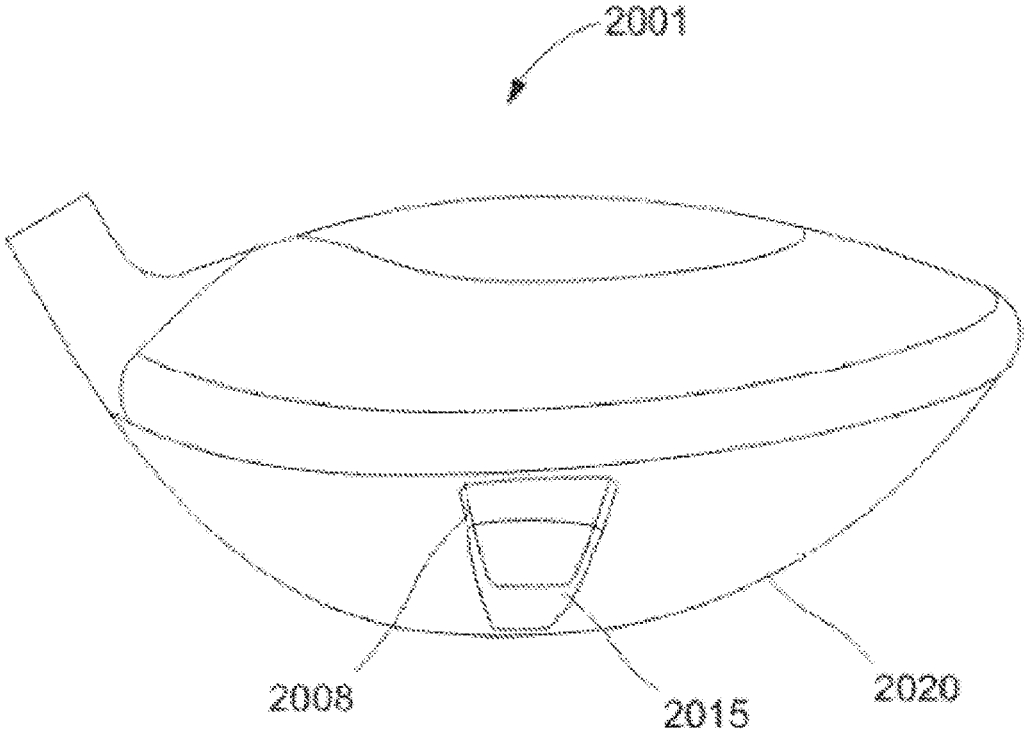
FIG. 21 is a rear or back view of the ridge-weighted golf club head of FIG. 20.

FIG. 21 is a back view of the ridge-weighted club head 2001 showing that the protruding element 2008 is describable as an integral medial ridge or styled integral shape that descends from the sole 2020. All or portions of (e.g., the weight member 2015) the protruding element 2008 may be made from the same, or other, lightweight material as the surrounding sole 2020. This protruding element 2008 may be made in a tangential relationship to the sole 2020 or may diverge in a non-tangential relationship from the base sole surface shape. It is preferred that the protruding element 2008 is tangentially blended into, and allows for smooth transition from, the base sole shape to allow airflow that occurs during a swing to more easily pass over the lower portion of the ridge-weighted club head 2001 with minimal drag. Due to the protruding element 2008 and the weighted member 2015, the CG is positioned within a few millimeters of an axis normal to and passing through a center point on the ball-striking face.

Figure 22:
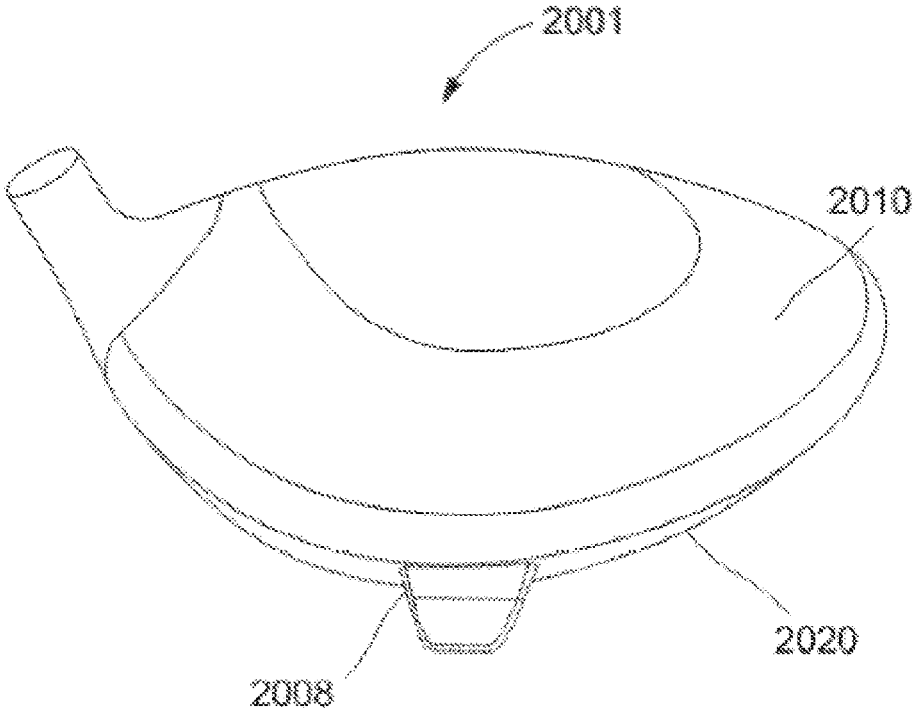
FIG. 22 is a rear perspective view of the ridge-weighted golf club head of FIG. 20.
Figure 23:
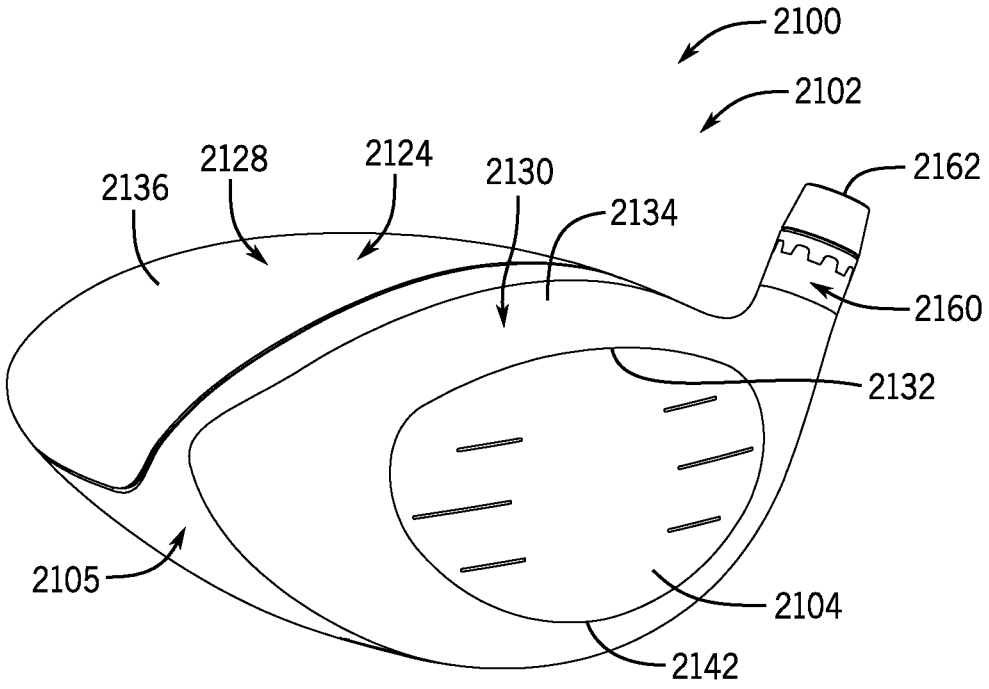
FIG. 23 is a top, front, right isometric view of a golf club head according to an embodiment of the present disclosure.

FIG. 22 is a rear perspective view of the ridge-weighted club head 2001 aiding in illustrating that the protruding element 2008 is coupled to an aft section of the sole 2020.

FIGS. 23-29 illustrate a golf club head 2100 according to one embodiment of the present disclosure. In general, the golf club head 2100 is designed to provide reduced aerodynamic drag during a golf swing, which provides increased distance when compared to conventional golf club heads. For example, the golf club head 2100 may reduce aerodynamic drag by incorporating heel-to-toe, sole-to-crown, and front-to-aft symmetries to create a highly streamlined club head geometry that reduces aerodynamic drag during a golf swing, specifically a down swing before impact. In some embodiments, the golf club head 2100 may be shaped to define a lower center of gravity in heel and toe portions to balance the raising of the center of gravity caused by a high trailing edge and large cross-sectional area in a center portion. The large area defined in the center portion of the golf club head 2100 provides improved curvature profiles that keep the airflow attached to the golf club head much longer, which further reduces aerodynamic drag and deviates from conventional golf club heads where the crown and sole curvatures in the center portions of the golf club head diverge more quickly toward the club heads center plane.

In the illustrated embodiment, the golf club head 2100 is a driver-type or a wood-type golf club head. The golf club head 2100 includes a body 2102 and a face portion 2104 coupled to the body 2102. In some embodiments, the face portion 2104 may comprise a ball-striking face of the golf club head 2100. In some embodiments, the face portion 2104 may comprise a face insert that is coupled to a frame 2105 of the body 2102. The body 2102 defines a toe side 2106, a heel side 2108, a front side 2110, a rear or aft side 2112, a top side 2114, and a bottom side 2116. The toe side 2106 is arranged opposite to the heel side 2108 along a heel-toe or an x– direction 2118 (see FIG. 25). The front side 2110 is arranged opposite to the rear or aft side 2112 along a front-aft or a y– direction 2120 (see FIG. 26). The top side 2114 is arranged opposite to the bottom side 2116 along a sole-crown or z– direction 2122 (see FIG. 25).

In the illustrated embodiment, the body 2102 includes an internal cavity 2123, a crown portion 2124, and a sole portion 2126. The crown portion 2124 is defined along the top side 2114 of the body 2102 and extends in the front-aft direction 2120. In the illustrated embodiment, the crown portion 2124 includes a crown plate 2128 that is coupled to the frame 2105. In some embodiments, the crown portion 2124 of the body 2102 may include portions of the frame 2105 and the crown plate 2128 that are visible from a top-down view, when the golf club head 2100 is at address (see, e.g., FIG. 26). For example, the crown portion 2124 may be formed by a crown transition region 2130 of the frame 2105 and portions of the crown plate 2128 that are arranged along the top side 2114 of the body 2102. In some embodiments, the crown transition region 2130 may include portions along the top side 2114 of the frame 2105 that extend between a top edge 2132 of the face portion 2104 and the crown plate 2128. For example, the crown transition region 2130 of the frame 2105 may include an outer crown transition surface 2134, and the crown plate 2128 may include an outer crown surface 2136.

The sole portion 2126 may be defined along the bottom side 2116 of the body 2102 and may extend in the front-aft direction 2120. In some embodiments, the sole portion 2126 of the body 2102 may include portions of the frame 2105 and the crown plate 2128 that are visible from a bottom-up view, when the golf club head 2100 is at address (see, e.g., FIG. 27). In the illustrated embodiment, the sole portion 2126 includes a sole region 2138 of the frame 2105 and a sole plate transition region 140 of the crown plate 128. For example, the sole region 2138 of the frame 2105 may include portions along the bottom side 2116 of the frame 2105 that extend between a bottom edge 2142 of the face portion 2104 and the crown plate 2128. The body 2102 defines an aftmost edge or skirt portion 2144 where the body 2102 transitions between the sole portion 2126 and the crown portion 2124. In some embodiments, the skirt portion 2144 may be defined as the edge formed by connecting points along the perimeter of the aft side 2112 of the body 2102 (e.g., along the transition between the crown portion 2124 and the sole portion 2126) where the slope of a line tangent to an outer surface of the body 2102 is normal to a ground plane GP. In the illustrated embodiment, the crown plate 2128 wraps around and forms the skirt portion 2144 and extends toward the bottom side 2116 of the body 2102 to form the sole transition region 2140. The sole transition region 2140 includes an outer sole transition surface 2146. In other embodiments, the crown plate 2128 and the sole region 2138 of the frame 2105 may meet at the skirt portion 2144 of the body 2102.

In some embodiments, the sole portion 2126 may include one or more adjustable weight assemblies coupled internally or externally to the body 2102. In the illustrated embodiment, the body 2102 includes a first weight 2148 and a second weight 2150 coupled to the sole portion 2126. The first weight 2148 and the second weight 2150 are coupled to an outer sole surface 2152 of the sole region 2138 in the frame 2105. The outer sole surface 2152 includes a recess for each of the first weight 2148 and the second weight 2150. For example, the outer sole surface 2152 includes a first recess 2154 within which the first weight 2148 is received (see FIG. 42). The first recess 2154 is shaped and dimensioned to receive the first weight 2148 therein, and a second recess (not shown) is shaped and dimensioned to receive the second weight 2150 therein. In the illustrated embodiment, the first weight 2148 and the second weight 2150 are coupled to the outer sole surface 2152 by a screw 2158 (see FIGS. 24, 27 and 29). The screws 2158 each include a screw bore 2161 within which a tool (e.g., a wrench) may be inserted to selectively remove the first weight 2148 and the second weight 2150. In the illustrated embodiment, the sole portion 2126 includes two laterally separated weights. In some embodiments, the sole portion 2126 may include more or less than two weight arranged at any location along the sole portion 2126. In some embodiments, the sole portion 2126 may include no weights.

The body 2102 includes a hosel 2160 extending from the heel side 2108 in a direction away from the toe side 2106. The hosel 2160 may include a ferrule 2162 that may be coupled to a shaft (not shown). The hosel 2160 defines a hosel axis H that extends through the center of the hosel 2160. When the golf club head 2100 is in an address position (see FIGS. 25, 26, 28, and 29), the hosel axis H is arranged at a lie angle A of about 60 degrees (see FIG. 25) relative to the ground plane and the hosel axis H intersects the ground plane GP at a ground intersection point 2164. In the address position, a vector extending outwardly and normal from a center point 166 on the face portion 104 may be aligned with an imaginary target line, and the hosel axis H may be arranged so that it lies in a vertical plane that is perpendicular to the ground plane GP. In general, the ground plane GP may be defined as an imaginary level plane upon with the golf club head 2100 rests in the address position. The dimensions and geometric quantities described herein relating to the golf club head 2100 may be measured with the golf club head 2100 in the address position, unless stated otherwise.

Figure 24:
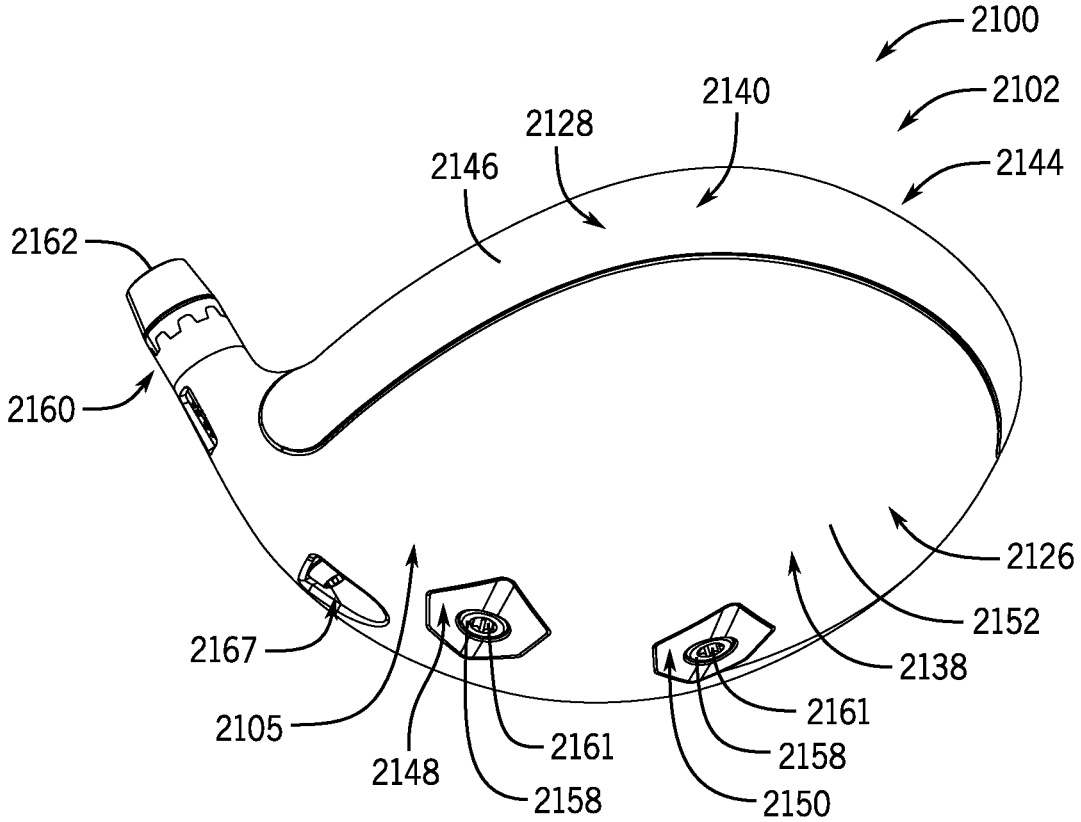
FIG. 24 is a bottom, back, left isometric view of the golf club head of FIG. 23.
Figure 25:
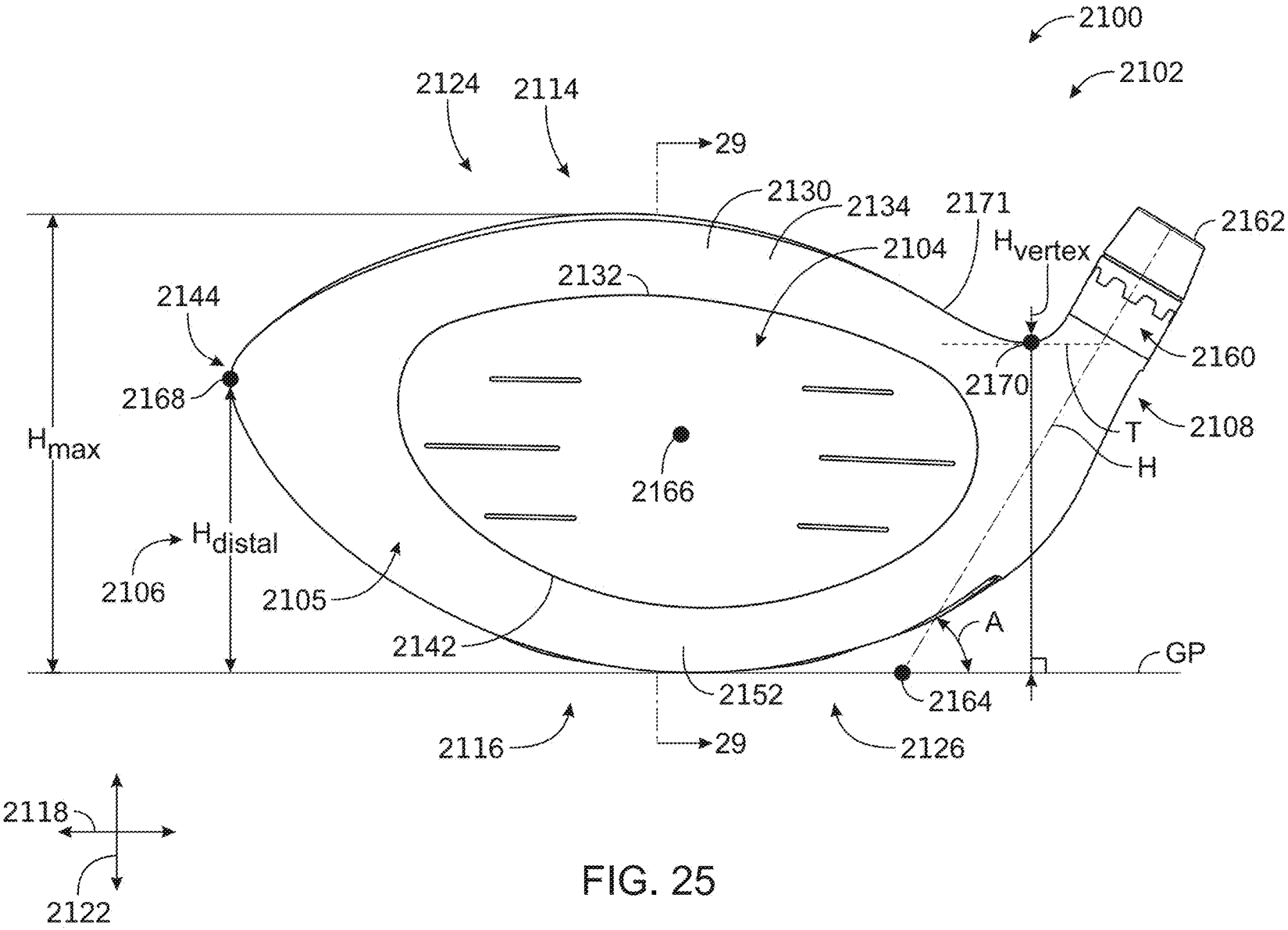
FIG. 25 is a front view of the golf club head of FIG. 23.
Figure 26:
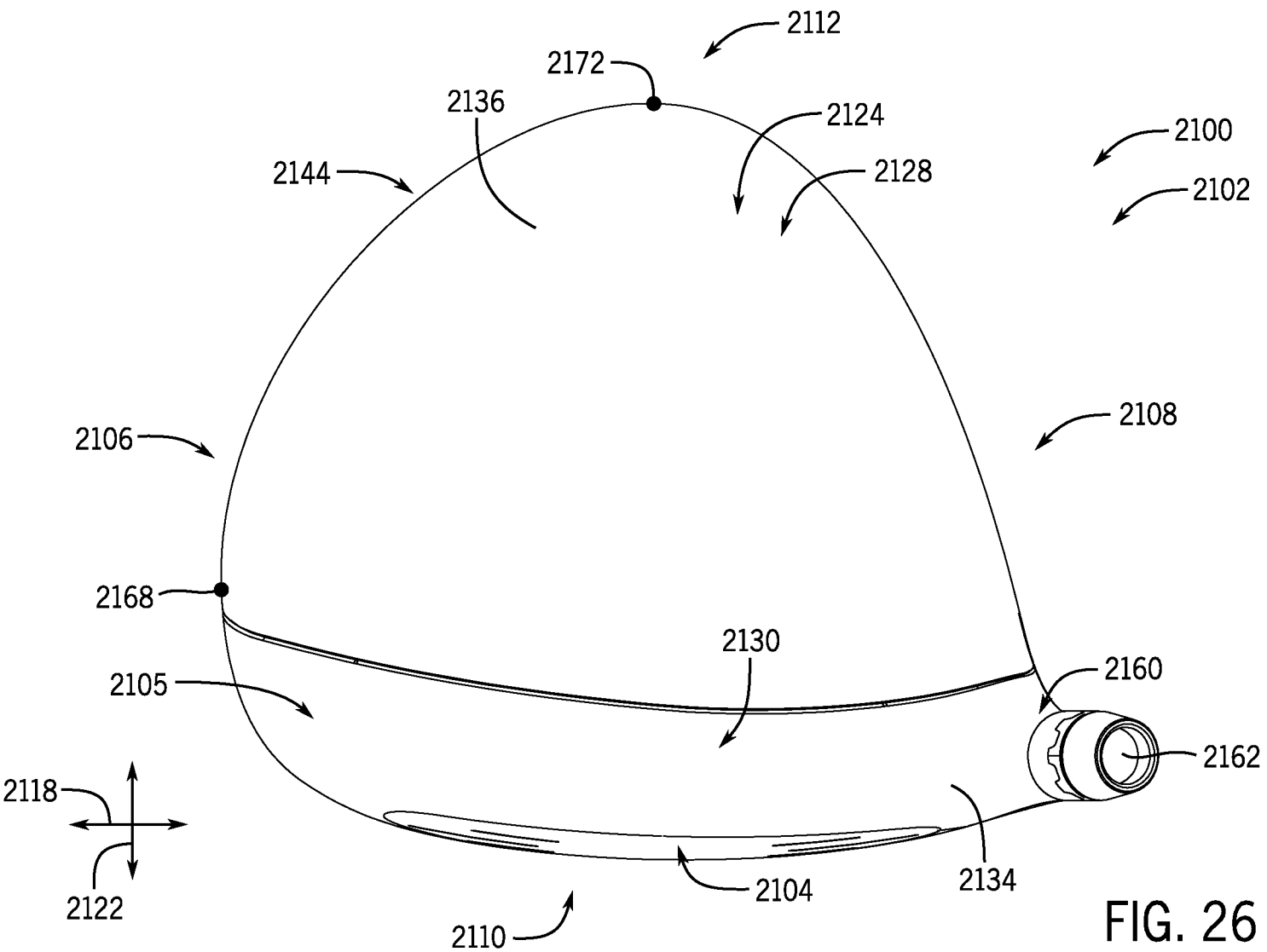
FIG. 26 is a top view of the golf club head of FIG. 23.
Figure 27:
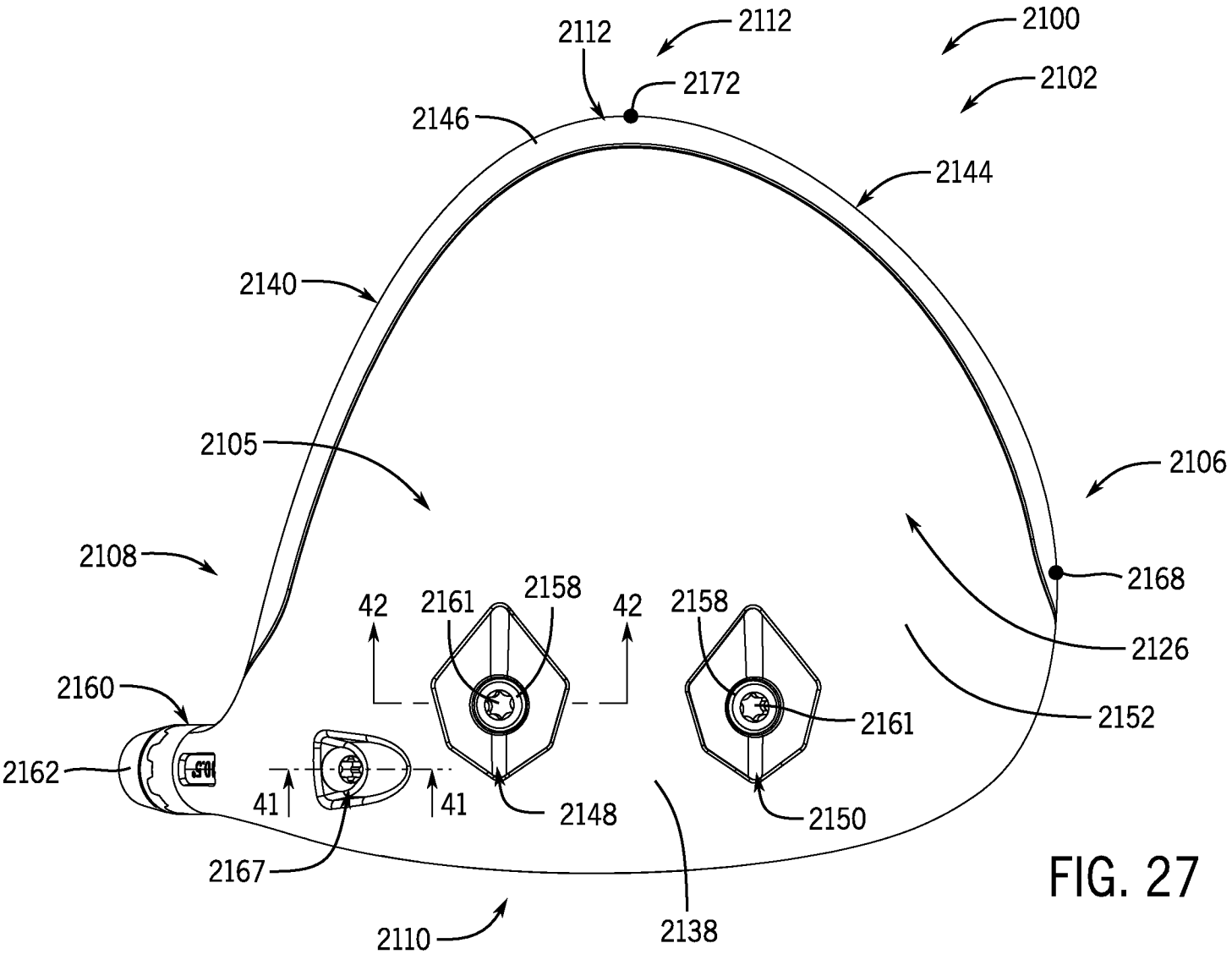
FIG. 27 is a bottom view of the golf club head of FIG. 23.

In the illustrated embodiment, the sole portion 2126 further includes a hosel pocket 2167 that defines a recess that extends into the outer sole surface 2152 (see FIG. 24. The hosel pocket 2167 provides a recess within with a shaft screw may be arranged that enables a user to either remove the shaft from the golf club head 2100 or adjust a loft and/or an angle of the face portion 104.

The golf club head 2100 is designed to include reduced skirt heights to streamline the body of the golf club head 2100 vertically (e.g., in a direction normal to the ground plane GP). In this way, for example, the golf club head 2100 may provide reduced aerodynamic drag throughout a down swing to increase club head speed and distance. In the illustrated embodiment, the skirt portion 2144 includes a distalmost point 2168 along the toe side 2106 of the body 2102. In some embodiments, the distalmost point 2168 along the toe side 2106 can be a point along the skirt portion 2144 that is arranged most distal from the heel side 2108, and/or the point along the toe side 2106 of the skirt portion 2144 where a line tangent to the outer surface of the skirt portion 144 is arranged perpendicular to the vertical plane extending through the hosel axis H when the golf club head 2100 is in the address position. In some embodiments, the height of the distalmost point 2168 in a direction normal to the ground plane GP is less than about 65% of a maximum height $H_{max}$ of the body 2102, or less than about 60% of the maximum height $H_{max}$ of the body 2102, or less than about 55% of the maximum height $H_{max}$ of the body 2102, or less than about 50% of the maximum height $H_{max}$ of the body 2102. In some embodiments, the height of the distalmost point 2168 in a direction normal to the ground plane GP is between about 65% and about 60% of the maximum height $H_{max}$ of the body 2102, or between about 60% and about 55% of the maximum height $H_{max}$ of the body 2102, or between about 55% and about 50% of the maximum height $H_{max}$ of the body 2102. In general, the height of the distalmost point 2168 being less than about 65% of the maximum height $H_{max}$ of the body 2102 provides significant advantages over conventional golf club heads (e.g., drivers or wood-type golf club heads) that define substantially larger ratios between the skirt height at the toe side and the maximum height, which hurts the aerodynamic performance of conventional golf club heads and increases drag forces. The lowering of the height of the skirt portion 2144 near the toe side 106 to lower than about 65% of the maximum height $H_{max}$ streamlines the shape of the body 102 and aids in reducing aerodynamic drag.

The golf club head 2100 further includes a reduced crown height adjacent to the hosel, which creates a more symmetric profile along the crown portion consistent with the reduced skirt height along the toe side, and also reduces aerodynamic drag to provide increased club head speeds and distance. In the illustrated embodiment, the crown portion 2124 includes a vertex point 2170 adjacent to the hosel 2160. The vertex point 2170 is defined as an uppermost point along the crown portion 2124 adjacent to the hosel 2160 where a slope of a line T tangent to the uppermost edge 2171 of the crown portion 2124 is parallel to the ground plane GP. In some embodiments, the vertex point 2170 defines a vertex height $H_{vertex}$ in a direction normal to the ground plane GP that is less than 75% of the maximum height $H_{max}$ of the body 2102, or less than about 65% of the maximum height $H_{max}$ of the body 2102, or less than about 60% of the maximum height $H_{max}$ of the body 2102. In some embodiments, the vertex point 2170 defines a vertex height in a direction normal to the ground plane GP that is between about 75% and about 70% of the maximum height $H_{max}$ of the body 2102, or between about 70% and about 65% of the maximum height $H_{max}$ of the body 2102, or between about 65% and about 60% of the maximum height $H_{max}$ of the body 2102. In general, the vertex height of the vertex point 2170 being less than about 75% of the maximum height $H_{max}$ of the body 2102 provides significant advantages over conventional golf club heads (e.g., drivers or wood-type golf club heads) that define substantially larger ratios between the vertex point height and the maximum height, which hurts the aerodynamic performance of conventional golf club heads and increases drag forces. The lowering of the vertex height to lower than about 75% of the maximum height $H_{max}$ streamlines the shape of the body 2102 and aids in reducing aerodynamic drag.

As described herein, a raised trailing edge height further aids in reducing aerodynamic drag. In the illustrated embodiment, the skirt portion 2144 defines an aftmost point 2172 along the aft side 2112 of the body 2102 and a trailing edge height of the body 2102 is defined as a height of the aftmost point 2172 measured in a direction normal to the ground plane GP. In some embodiments, the trailing edge height of the body 2102 is greater than about 40% of the maximum height $H_{max}$ of the body 2102, or greater than about 45% of the maximum height $H_{max}$ of the body 2102, or greater than about 50% of the maximum height $H_{max}$ of the body 2102, or greater than about 55% of the maximum height $H_{max}$ of the body 2102, or greater than about 60% of the maximum height $H_{max}$ of the body 2102. In some embodiments, the trailing edge height is between about 40% and about 60% of the maximum height $H_{max}$ of the body 2102, or between about 45% and about 55% of the maximum height $H_{max}$ of the body 2102, or between about 50% and about 55% of the maximum height $H_{max}$ of the body 2102.

Figure 28:
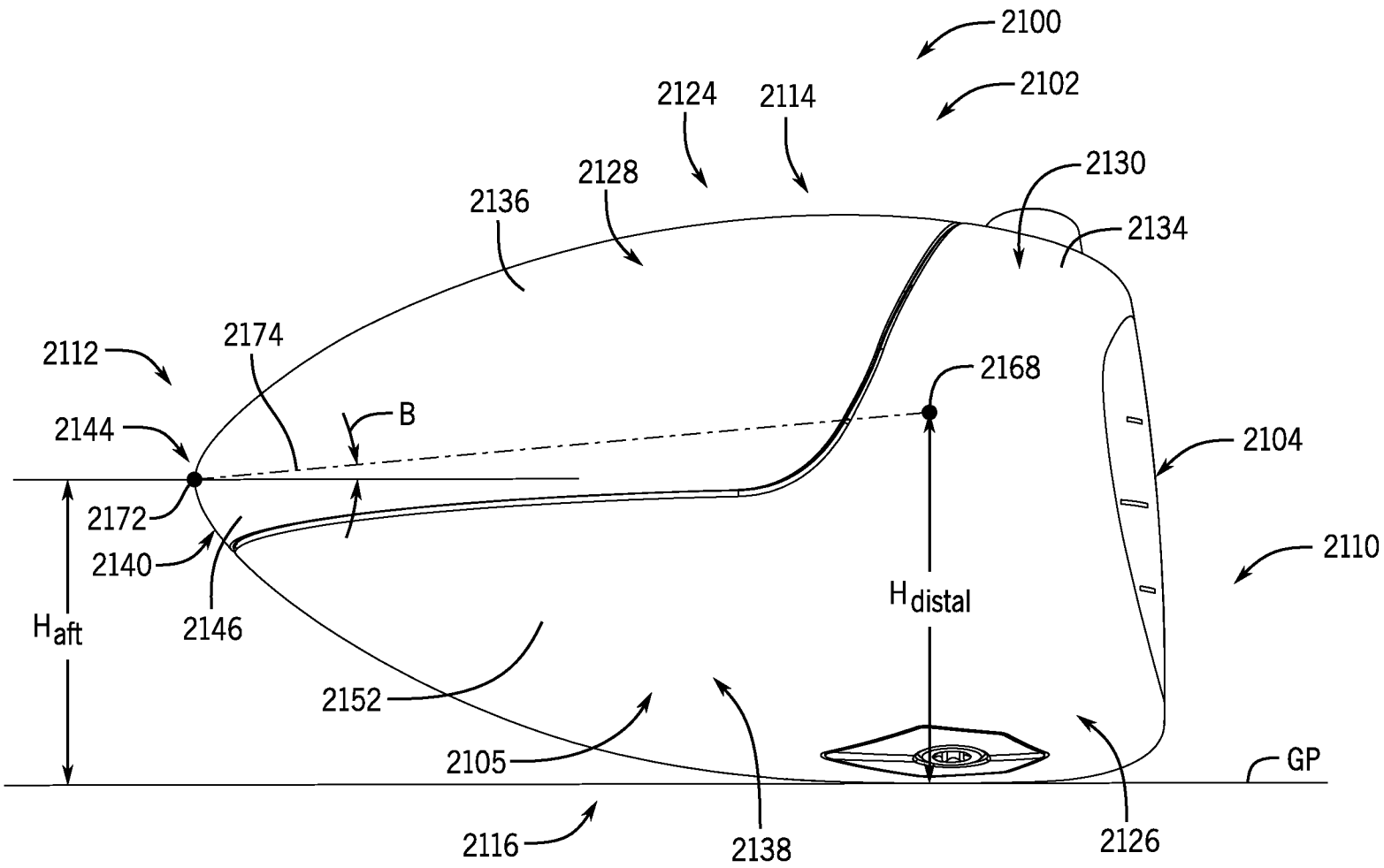
FIG. 28 is a right side view of the golf club head of FIG. 23.
Figure 29:
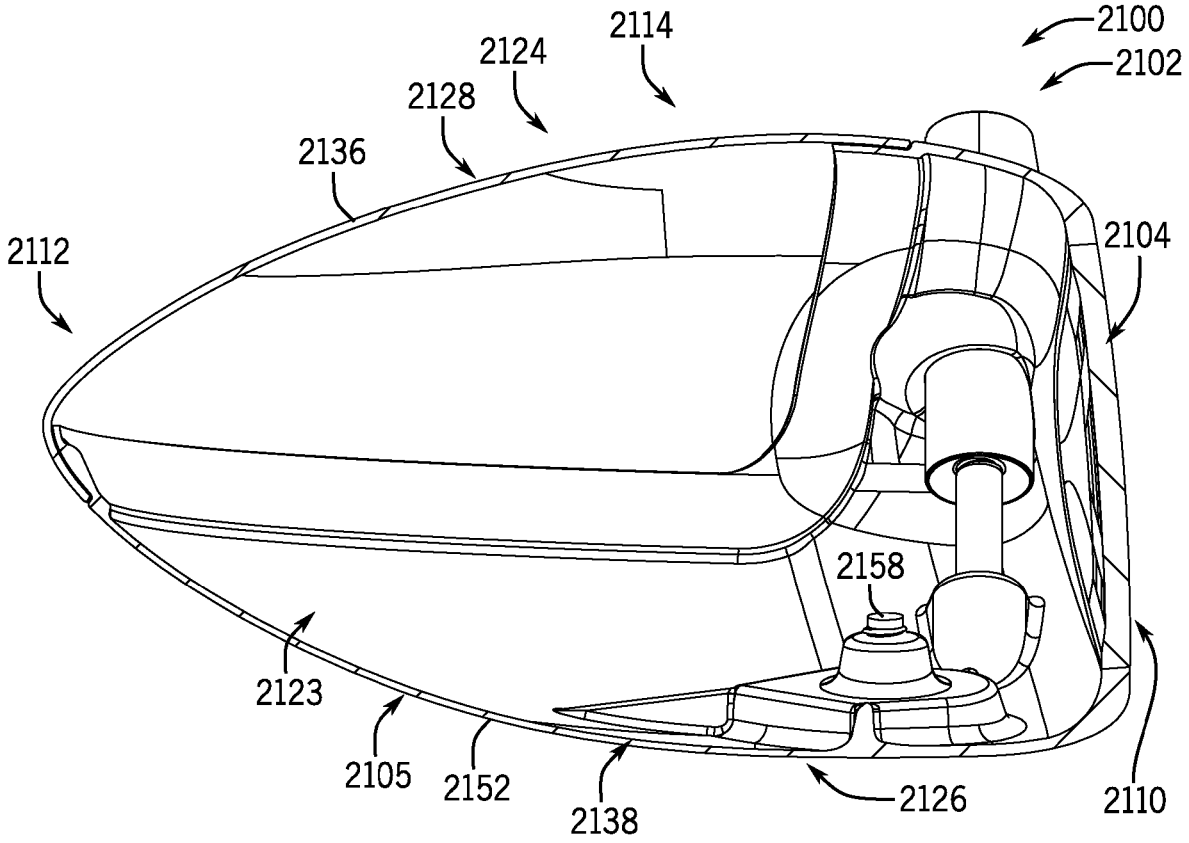
FIG. 29 is a cross-sectional view of the golf club head of FIG. 25 taken along plane 29-29.
Figure 31:
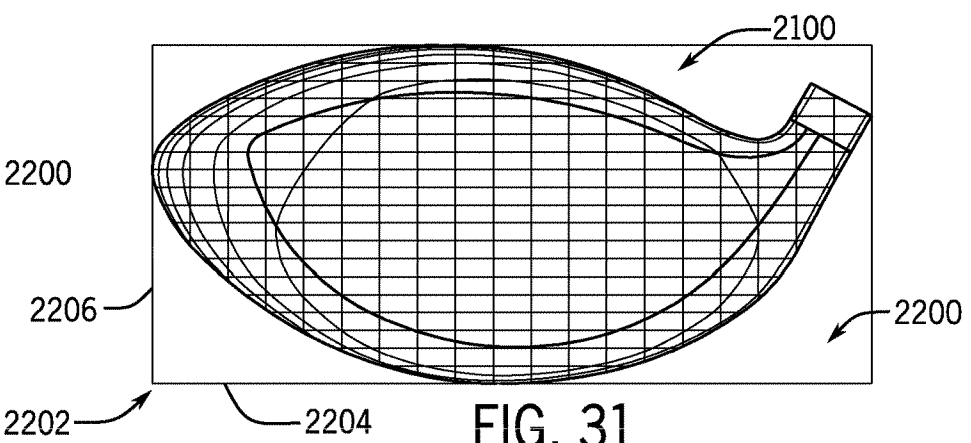
FIG. 31 is a front view of the golf club head of FIG. 30.
Figure 30:
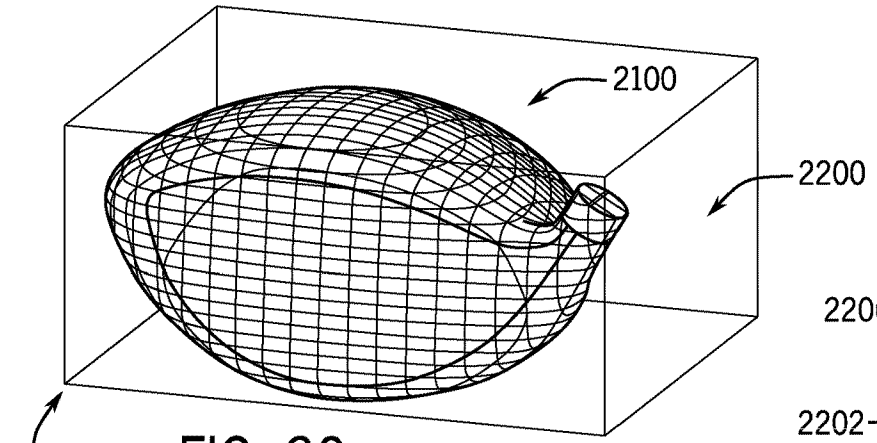
FIG. 30 is a top, front, left isometric view of the golf club head of FIG. 23 enclosed within a rectangular volume and illustrating heel-toe, sole-crown, and face-aft cross-sectional planes.
Figure 33:
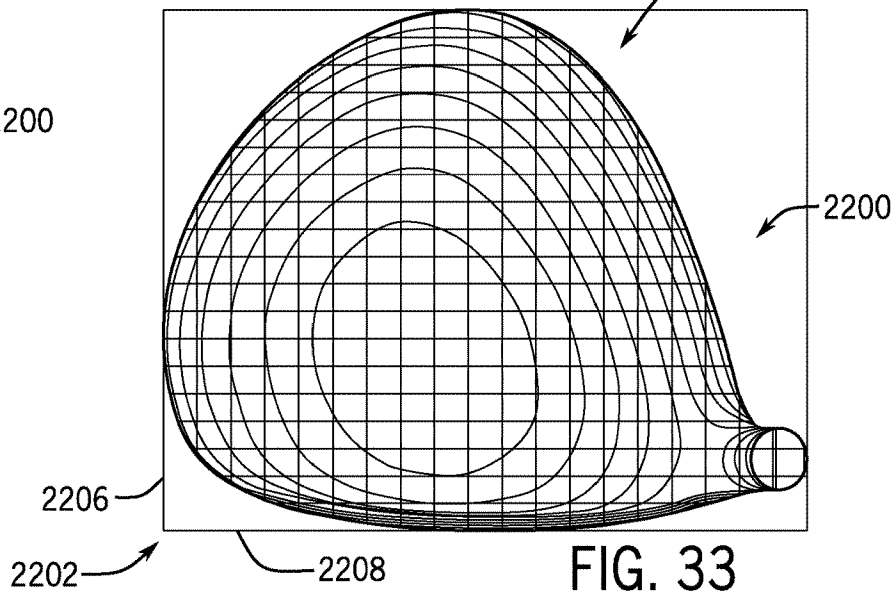
FIG. 33 is a top view of the golf club head of FIG. 30.
Figure 32:
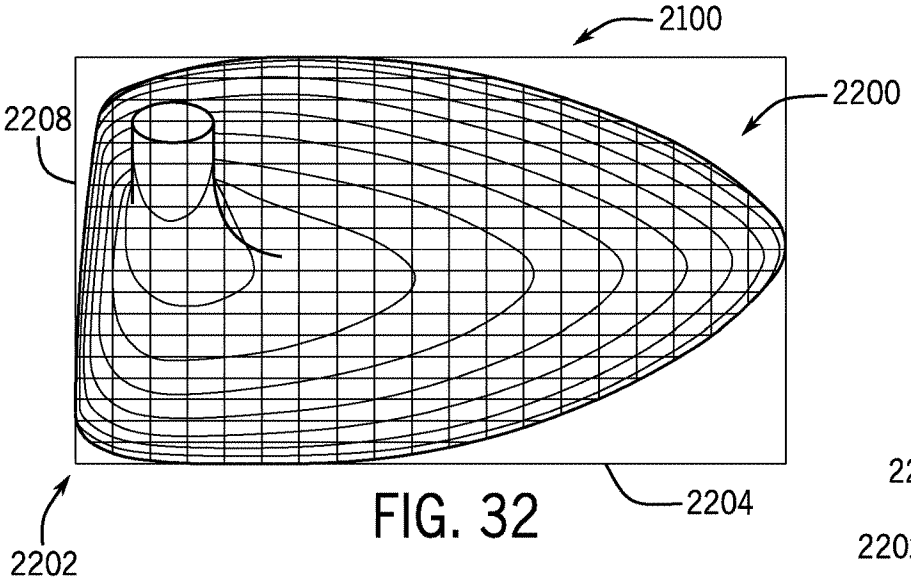
FIG. 32 is a left side view of the golf club head of FIG. 30.

The golf club head 2100 also includes a parting line, or toe skirt, that is flattened out (e.g., slopped closer to parallel to the ground plane) to further streamline the body of the golf club head 2100. In general, flattening out the parting line reduces the tendency of the flow over the golf club head 2100 to separate, which further reduces aerodynamic drag on the golf club head 2100. In the illustrated embodiment, the parting line 2174 is defined as an imaginary line connecting the distalmost point 2168 along the toe side 2106 and the aftmost point 2172 (see FIG. 28). As the parting line 2174 extends in a direction from the distalmost point 2168 toward the aftmost point 2172, the parting line 2174 extends downward in a direction toward the ground plane GP to define a parting line slope or grade. The parting line slope or grade is defined by the following equation:

$$PL_{slope}=100*\tan B$$

where B is the angle in degrees formed between the parting line 2174 and the ground plane GP. The angle 2B is illustrated with respect to a plane that is parallel to the ground plane in FIG. 28 because the actual intersection between the parting line 2174 and the ground plane GP may not fit on the page. It would be appreciated by one of skill in the art that the angle B illustrated in FIG. 28 is the same as the angle formed at the intersection between the parting line 2174 and the ground plane GP because of the geometric properties of corresponding angles formed when a line intersects two parallel planes. Based on the geometry between the parting line 2174 and the ground plane GP, the parting line slope can alternatively be defined by the equation:

$$PL_{slope} = 100*\left(\frac{H_{dist} - H_{aft}}{D}\right)$$

where $H_{dist}$ is the height of the distalmost point 2168, Haft is the height of the aftmost point 2172, and D is the distance between the distalmost point 2168 and the aftmost point 2172 measured along a direction parallel to the ground plane GP (e.g., the distance D is the adjacent side of a right triangle formed with the parting line 2174 as the hypotenuse and the angle B formed between the parting line 2174 and the adjacent side).

In some embodiments, the parting line slope or grade is less than about 10%, or less than about 9%, or less than about 8%, or less than about 7%, or less than about 6%, or less than about 5%. In some embodiments, the parting line slope or grade is between about 10% and about 5%, or between about 9% and about 6%, or between about 8% and about 7%. In general, the parting line slope being less than 10% flattens out the shape of the body 2102 along the toe side 2106 to reduces the tendency of the flow over the golf club head 2100 to separate and, thereby, aids in reducing aerodynamic drag. This differs from conventional golf club heads that define much larger parting line slopes (e.g., greater than 20%) due to taller designs along the toe side (e.g., larger frontal area) and lower trailing edge heights.

The aerodynamic benefits of the golf club head 2100 are further exemplified in the cross-sectional areas and centroids taken at various locations along the body 2102 in one or more planes. For example, FIGS. 30-33 illustrate the golf club head 2100 enclosed within a rectangular volume 2200 that represents the outermost extents of the body 2102 (e.g., the max height $H_{max}$, the max length, and the max width). The golf club head 2100 is oriented within the rectangular volume 2200 and oriented relative to a coordinate system 2202. The coordinate system 2202 includes an x-y plane 2204, a y-z plane 2206, and a x-z plane 2208. The x-y plane 2204 is the same as the ground plane GP described above with reference to FIGS. 23-29.

The golf club head 2100 is arranged within the rectangular volume 2200 so that the hosel axis H lies in a plane that is parallel with the x-z plane 2208 (e.g., in a plane that extends through the hosel axis H and is perpendicular to the ground plane GP or x-y plane 2204). The golf club head 2100 is then rotated until the hosel axis H is at a 60-degree angle relative to the x-y plane 2204 (e.g., the lie angle A is 60 degrees). The golf club head 2100 is then rotated through the hosel axis H until a vector extending outwardly and normal from the center point 2166 on the face portion 2104 is parallel with the y-z plane 206. This orientation of the golf club head 2100 is the same as the address position described above with respect to FIGS. 23-29. In this orientation, the golf club head 2100 may be enclosed by the rectangular volume 2200, where rectangular volume 2200 intersects the outermost points on all six sides of the body 2102. The origin of the coordinate system 2202 is arranged at the front, toe, sole corner of the rectangular volume 2200, with the axes being aligned with the respective edges of the rectangular volume 2200, as shown in FIGS. 30-33.

Figure 34:
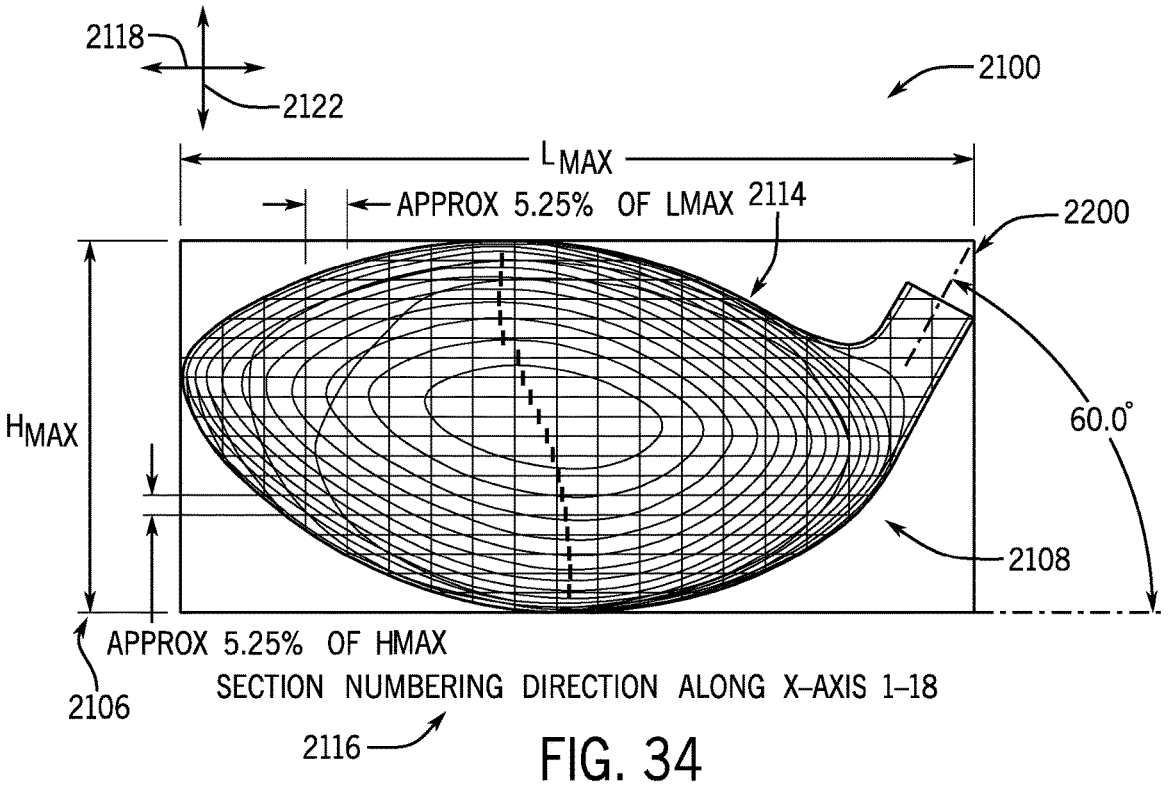
FIG. 34 is a schematic illustration of the golf club head of FIG. 31 illustrating the geometric arrangement of the cross-sectional planes.
Figure 35:
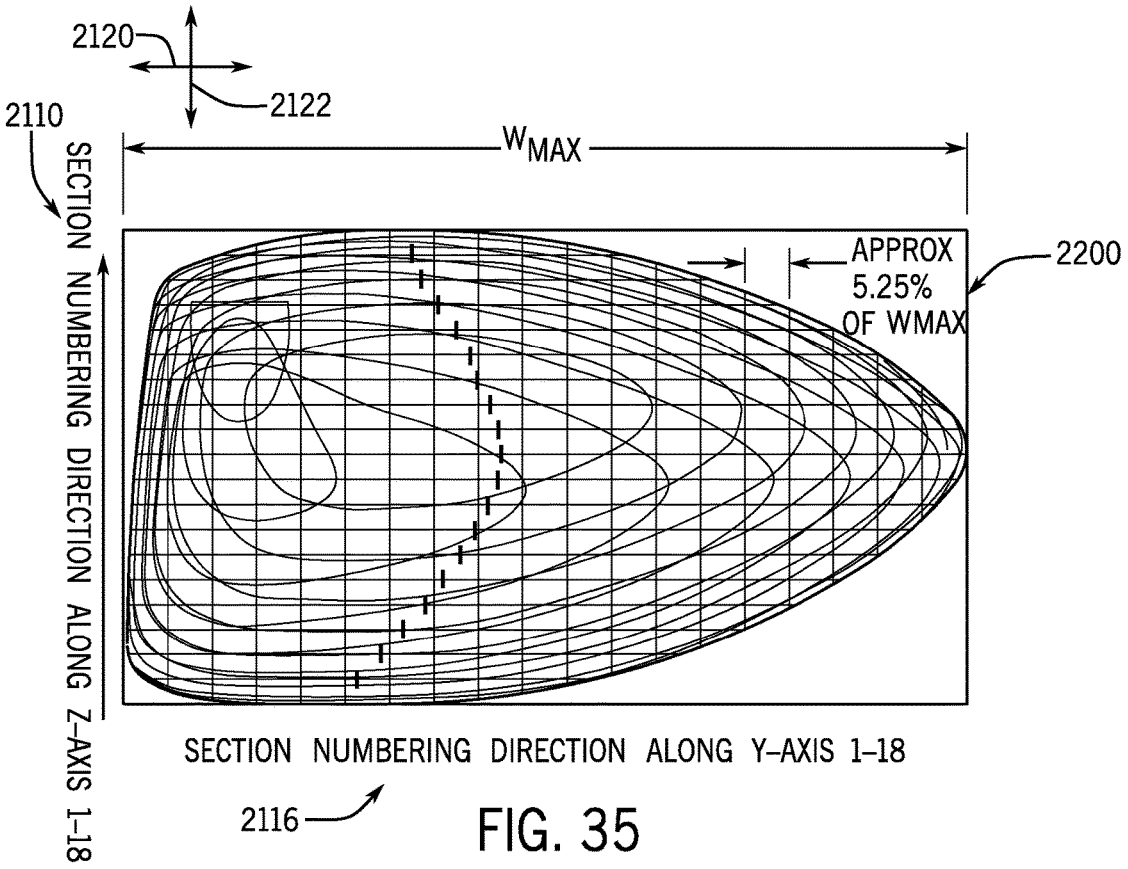
FIG. 35 is a schematic illustration of the golf club head of FIG. 32 illustrating the geometric arrangement of the cross-sectional planes.

The coordinate system 2202 is the datum for all the coordinates, measurements, and dimensions for referencing the following evaluation of centroid locations and cross-sectional areas. Turning to FIGS. 34 and 35, the body 2102 of the golf club head 2100 is partitioned into eighteen cross-sections that are evenly spaced along the length, width, and height of the rectangular volume 2200 with respect to the x, y, and z orientations in the coordinate system 2202. For example, the body 2102 is partitioned into eighteen heel-toe cross sections (i.e., the sections are spaced in the heel-toe direction 2118) that are arranged parallel to the y-z plane 2206 and spaced evenly along the x-axis (e.g., the heel-toe direction 2118), so that the first cross section is arranged adjacent to the toe side 2106 and the eighteenth cross section is arranged adjacent to the heel side 2108 (see FIG. 34). Each of the heel-toe cross sections is arranged perpendicular to the x-y plane 2204 (or the ground plane GP) and perpendicular to a plane that extends through the hosel axis H and is perpendicular to the ground plane GP (e.g., a plane parallel to the x-z plane 2208). In some embodiments, the heel-toe cross-sections are evenly spaced in increments of about 5.25% of a maximum length $L_{max}$ of the body 2102.

The body 2102 is also partitioned into eighteen sole-crown cross sections (i.e., the sections are spaced in the sole-crown direction 2122) that are arranged parallel to the x-y plane 2204 or the ground plane GP and spaced evenly along the z-axis (e.g., the sole-crown direction 2122), so that the first cross section is arranged adjacent to the bottom side 2116 and the eighteenth cross section is arranged adjacent to the top side 2114 (see FIG. 35). In some embodiments, the sole-crown cross sections are evenly spaced in increments of about 5.25% of the maximum height $H_{max}$ of the body 2102. The body 2102 is further partitioned into eighteen face-aft cross sections (i.e., the sections are spaced in the front-aft direction 2120) that are arranged parallel to the x-z plane 2208 (e.g., parallel to a plane that extends through the hosel axis H and is arranged perpendicular to the ground plane GP), so that the first cross section is arranged adjacent to the front side 2110 and the eighteenth cross section is arranged adjacent to the aft side 2112 (see FIG. 35). In some embodiments, the face-aft cross sections are evenly spaced in increments of about 5.25% of a maximum width $W_{max}$ of the body 2102.

Figure 36:
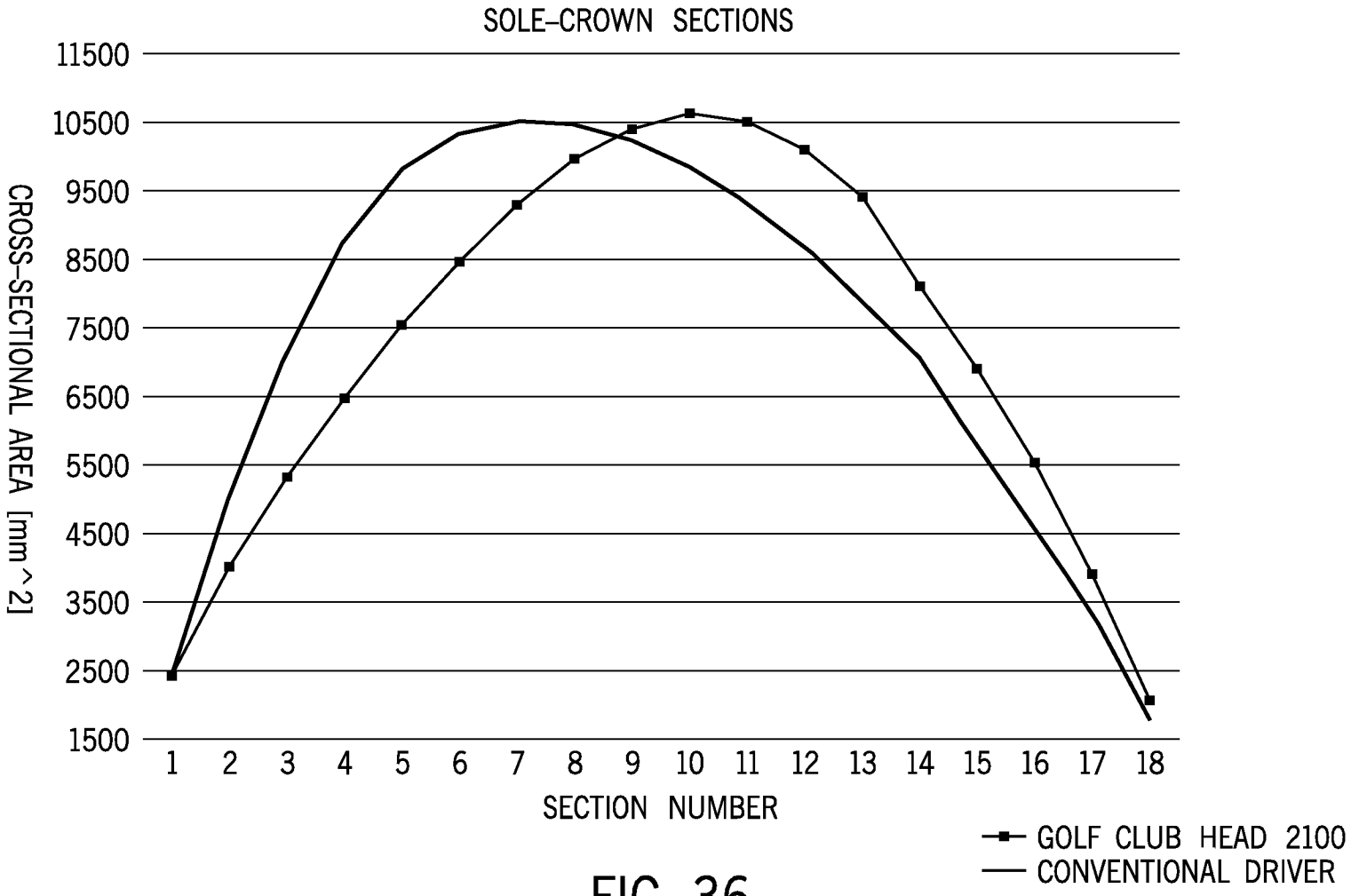
FIG. 36 is a graph illustrating sole-crown cross-sectional areas for the golf club head of FIG. 23 and a conventional driver.

For each of the heel-toe, sole-crown, and face-aft cross sections, a total cross-sectional area encompassed by the plane and a centroid (x,y,z coordinate) defined by the plane can be determined. FIG. 36 illustrates a graph of the cross-sectional area defined by the sole-crown sections for the golf club head 2100 and a conventional driver. As illustrated in FIG. 36, the golf club head 2100 defines a substantially more symmetric shape compared to the conventional driver. In general, conventional drivers typically include more volume adjacent to the sole (the first section in the graph of FIG. 36 is closest to the sole or bottom side 2116) to lower the center of gravity. These non-symmetric shapes defined by conventional drivers result in poor aerodynamic performance and often require trip members on the crown, slots, steps, or channels on the sole, and/or other turbulence-inducing structures be incorporated into the club head, which add complexity and cost to the club head. The profile of the cross-sectional areas defined by the sole-crown sections in FIG. 36 illustrate that the shape, contours, and volume of the body 2102 are more symmetrically distributed about a midplane (i.e., a plane arranged parallel to the ground plane and extending through the body 2102 at a half-head height $H_{half}$, which is half of the maximum height $H_{max}$ of the body 2102). The symmetric nature of the sole-crown sections about the midplane is a key indicator of streamlining and contributes to lowering the aerodynamic drag experienced by the golf club head 2100.

In some embodiments, the symmetric characteristics of a golf club head may be assessed by how close location of a maximum cross-sectional area is to a midplane defined in the direction of cross-sectional planes. In the illustrated embodiment, the body 2102 defines a maximum sole-crown plane, which defines a maximum cross-sectional area of the body 2102 taken in a plane parallel to the ground plane GP (i.e., parallel to the x-y plane 2204), that is arranged at a height defined in a direction normal to the ground plane GP. The height of the maximum sole-crown plane may be determined by taking the derivative of the curve in FIG. 36 and finding the x-intercept (i.e., the peak of the curve corresponds to where the slope of a line tangent to the curve equals zero). How close the height of the maximum sole-crown plane is to the half-head height $H_{half}$ can be determined by evaluating what percentage of the half-head height $H_{half}$ the difference between the height of the maximum sole-crown plane and the half-head height $H_{half}$ represents. In the illustrated embodiment, the difference between the height of the maximum sole-crown plane and the half-head height $H_{half}$ is less than or equal to plus or minus 10% of the half-head height $H_{half}$, which is represented by the equation below:

$$H_{max}-H_{half}\leq\pm10\%*H_{half}$$

where $H_{max}$ is the height of the maximum sole-crown plane. In some embodiments, the difference between the height of the maximum sole-crown plane and the half-head height $H_{half}$ is less than or equal to plus or minus 9% of the half-head height $H_{half}$, or less than or equal to plus or minus 8% of the half-head height $H_{half}$, or less than or equal to plus or minus 7% of the half-head height $H_{half}$, or less than or equal to plus or minus 6% of the half-head height $H_{half}$, or less than or equal to plus or minus 5% of the half-head height $H_{half}$, or less or equal to than plus or minus 4% of the half-head height $H_{half}$, or less than or equal to plus or minus 3% of the half-head height $H_{half}$, or less than or equal to plus or minus 2% of the half-head height $H_{half}$, or less than or equal to plus or minus 1% of the half-head height $H_{half}$. In some embodiments, the streamlined properties of the body 102 illustrated by the symmetrical cross-sectional areas in FIG. 36 can be realized when the difference between the height of the maximum sole-crown plane and the half-head height $H_{half}$ is at least less than plus or minus 10% of the half-head height $H_{half}$.

In addition to the streamlined properties of the golf club head 2100 illustrated by the sole-crown sections, the golf club head 2100 further defines streamlined properties in the heel-toe cross sections. For example, the body 2102 of the golf club head 2100 defines lower heights relative to the ground plane GP in the toe side 2106 and heel side 2108, as exemplified by the heights of the distalmost point 2168 and the aftmost point 2172. The lower heights at the respective points are continued along the toe and heel portions of the body (e.g., in a toe portion including the first heel-toe section to the third heel-toe section and over a heel portion including the fourteenth heel-toe section to the sixteenth heel-toe section). The lower heights in the toe and heel portions aid in streamlining the golf club head 2100 and help lower the center of gravity. In addition, the body 2102 of the golf club head 2100 is designed to include a center portion (e.g., including heel-toe section eight to heel-toe section ten) that defines large cross-sectional areas, which is due to improved curvature profiles that help streamline the body 2102 and keep airflow attached to the body 2102 much longer than conventional drivers. These design properties of the golf club head 2100 are illustrated in FIGS. 37-39.

Figure 37:
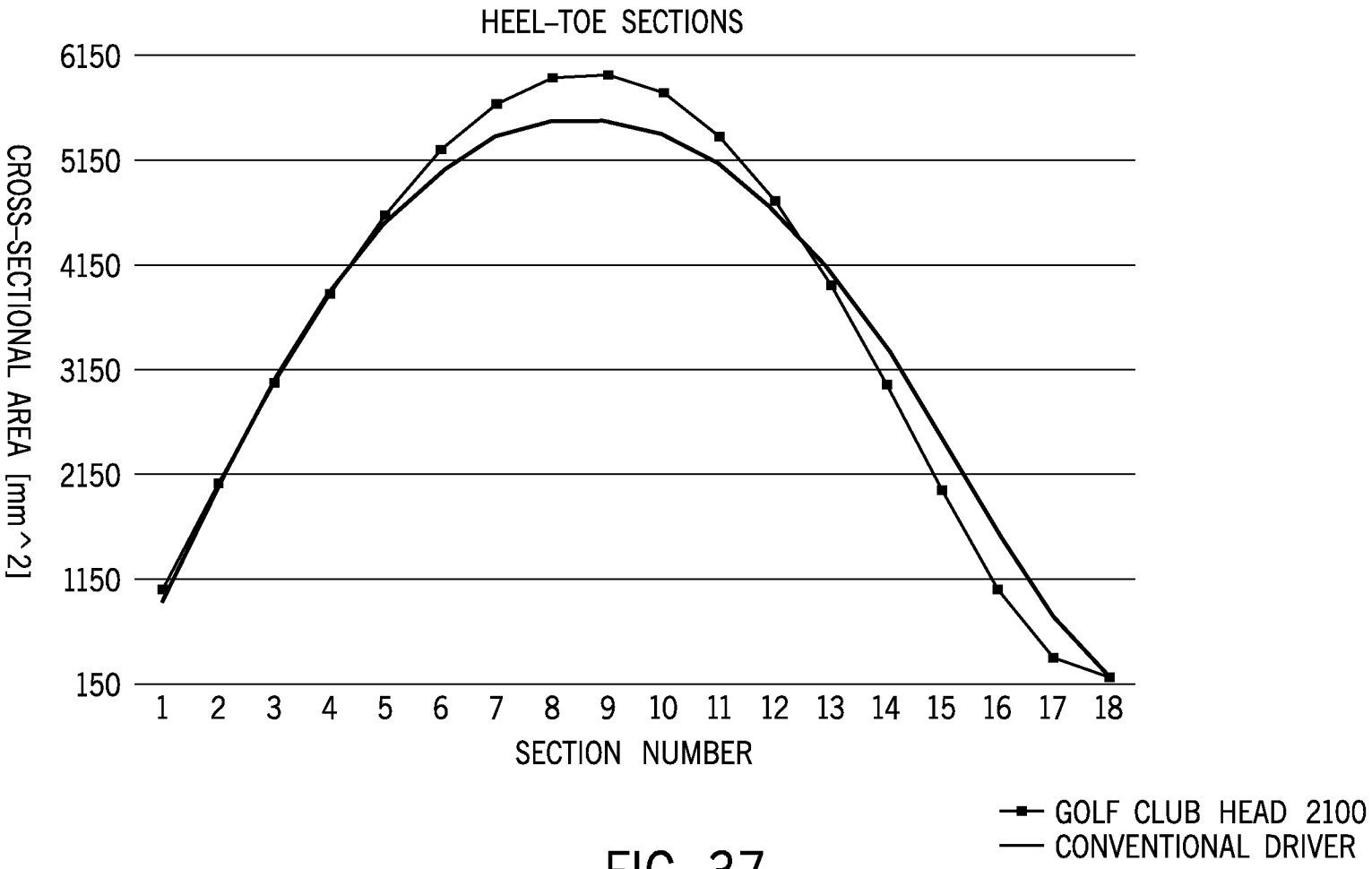
FIG. 37 is a is a graph illustrating heel-toe cross-sectional areas for the golf club head of FIG. 23 and a conventional driver.

FIG. 37 illustrates a graph of the cross-sectional area defined by the heel-toe sections for the golf club head 2100 and a conventional driver. As illustrated in FIG. 37, the golf club head 2100 defines a substantially more symmetric shape compared to the conventional driver and includes a greater cross-sectional area in the center portion (i.e., sections eight through ten). Like the sole-crown section, the symmetric nature of the heel-toe sections is a key indicator of streamlining and contributes to lowering the aerodynamic drag experienced by the golf club head 2100. In some embodiments, an average value of the cross-sectional area defined by the eighth heel-toe section, the ninth heel toe section, and the tenth heel-toe section is greater than about 5700 square millimeters, or greater than about 5800 square millimeters, or greater than about 5900 square millimeters, or greater than about 6000 square millimeters. In general, the average cross-sectional area defined by the center sections (i.e., sections eight through ten) being greater than 5700 square millimeters aids in the body 2102 defining curvature profiles that help streamline the body 2102 and reduce aerodynamic drag.

Another indicator of the aerodynamic performance of a golf club head can be determined by a ratio of cross-sectional areas in the center portion and the heel portion. In general, a golf club head with improved aerodynamic properties will include a lower cross-sectional area in the heel portion and a larger cross-sectional area in the center portion. In some embodiments, a ratio of an average cross-sectional area defined by the eighth heel-toe section, the ninth heel-toe section, and the tenth heel-toe section to an average cross-sectional area defined by the fourteenth heel-toe section, the fifteenth heel-toe section, and the sixteenth cross section is greater than about 2.8, or greater than about 2.9, or greater than about 3.0, or greater than about 3.1, or greater than about 3.2, or greater than about 3.3, or greater than about 3.4, or greater than about 3.5. In general, the ratio between the average cross-sectional area of the heel-toe sections eight through ten to the average cross-sectional area of the heel-toe sections fourteen through sixteen being greater than at least 2.8 ensures that the body 2102 defines a large enough cross-sectional area in the center portion and a small enough area in the heel portion (e.g., due to lower heights in a direction normal to the ground plane GP) to ensure improved aerodynamic properties and reduced aerodynamic drag.

Figure 38:
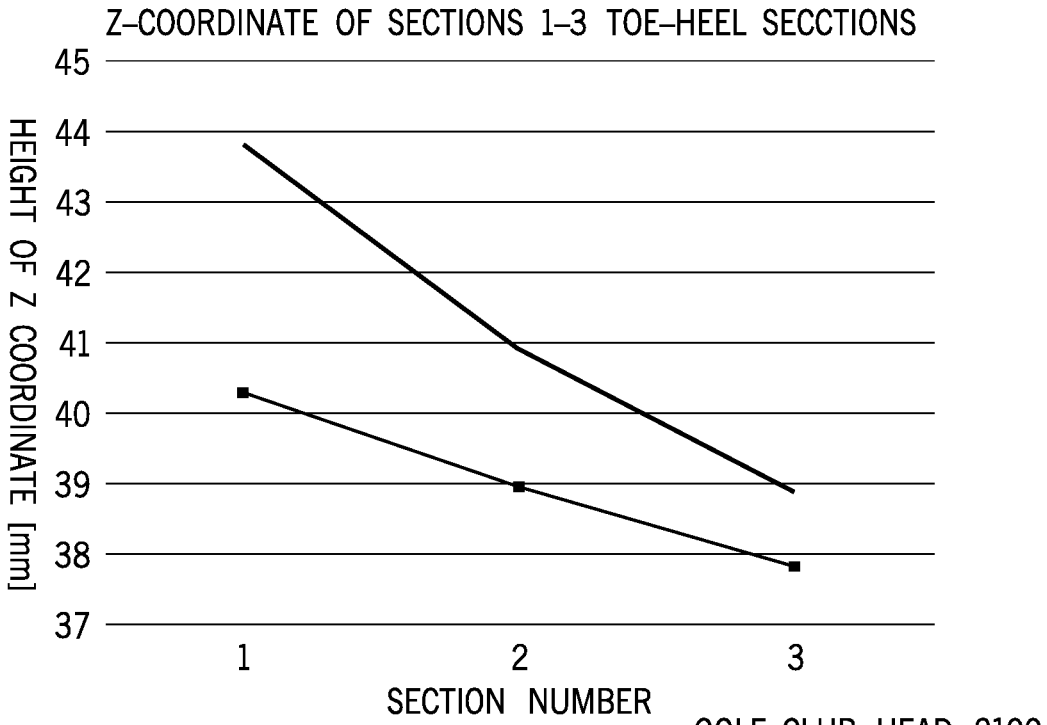
FIG. 38 is a graph illustrating a z-coordinate for a centroid of heel-toe cross sections in a toe portion for the golf club head of FIG. 23 and a conventional driver.
Figure 39:
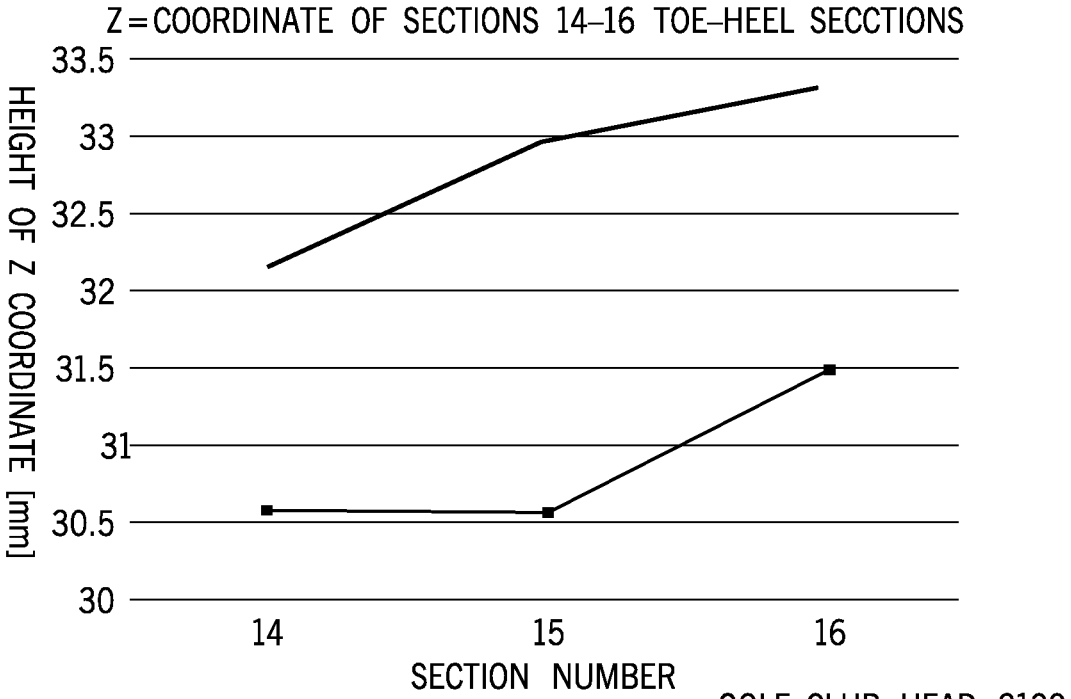
FIG. 39 is a graph illustrating a z-coordinate for a centroid of heel-toe cross sections in a heel portion for the golf club head of FIG. 23 and a conventional driver.

Turning to FIGS. 38 and 39, the lowered geometries defined by the body 2102 in the toe portion (i.e., heel-toe sections one through three) and the heel portion (i.e., heel-toe sections fourteen through sixteen) is further exemplified in the z-coordinate (i.e., a height in a direction normal to the ground plane GP or the x-y plane 2204) of a centroid defined by the heel-toe sections. As shown in FIG. 38, the z-coordinate or toe height coordinate of the centroid defined by each of the first heel-toe second, the second heel-toe section, and the third heel-toe section is smaller than a conventional driver, which illustrates that the toe portion is closer to the ground plane GP and defines a lower center of gravity. Similarly, as shown in FIG. 39, the z-coordinate or heel height coordinate of the centroid defined by each of the fourteenth heel-toe section, the fifteenth heel-toe section, and the sixteenth heel-toe section is smaller than the conventional driver, which illustrates that the heel portion is closer to the ground plane GP and defines a lower center of gravity.

In some embodiments, an average value of the toe height coordinate defined by the first cross section, the second heel-toe section, and the third heel-toe section is less than about 41 millimeters, or less than about 40 millimeters, or less than about 39 millimeters, or less than about 38 millimeters, or less than about 37 millimeters, or less than about 36 millimeters, or less than about 35 millimeters. In some embodiments, an average value of the heel height coordinate defined by the fourteenth heel-toe section, the fifteenth heel-toe section, and the sixteenth heel-toe section is less than about 40 millimeters, or less than about 39 millimeters, or less than about 38 millimeters, or less than about 37 millimeters, or less than about 36 millimeters, or less than about 35 millimeters.

As described herein, conventional golf club heads typically include trip members on the crown, slots, steps, or channels on the sole, and/or other turbulence-inducing structures to compensate for aerodynamic inefficiencies in the overall club head shape/contours. As described herein, the golf club head 2100 is designed to be aerodynamically efficient without the use of the extra turbulence-inducing components via the curvatures, profiles, and cross-sectional area distributions along the body 2102. In fact, the lack of interruptions along the body 2102 may further improve the aerodynamic properties of the golf club head 2100. For example, the golf club head 2100 may include a plug assembly to fill interruptions along the crown portion 2124 or the sole portion 2126. In general, interruptions may be defined as a discontinuity along a surface that is formed, for example, by a step, slot, channel, aperture, bore, recess, or a groove. Surface interruptions can create unwanted drag that promote flow separation and hurt streamlining.

Figure 40:
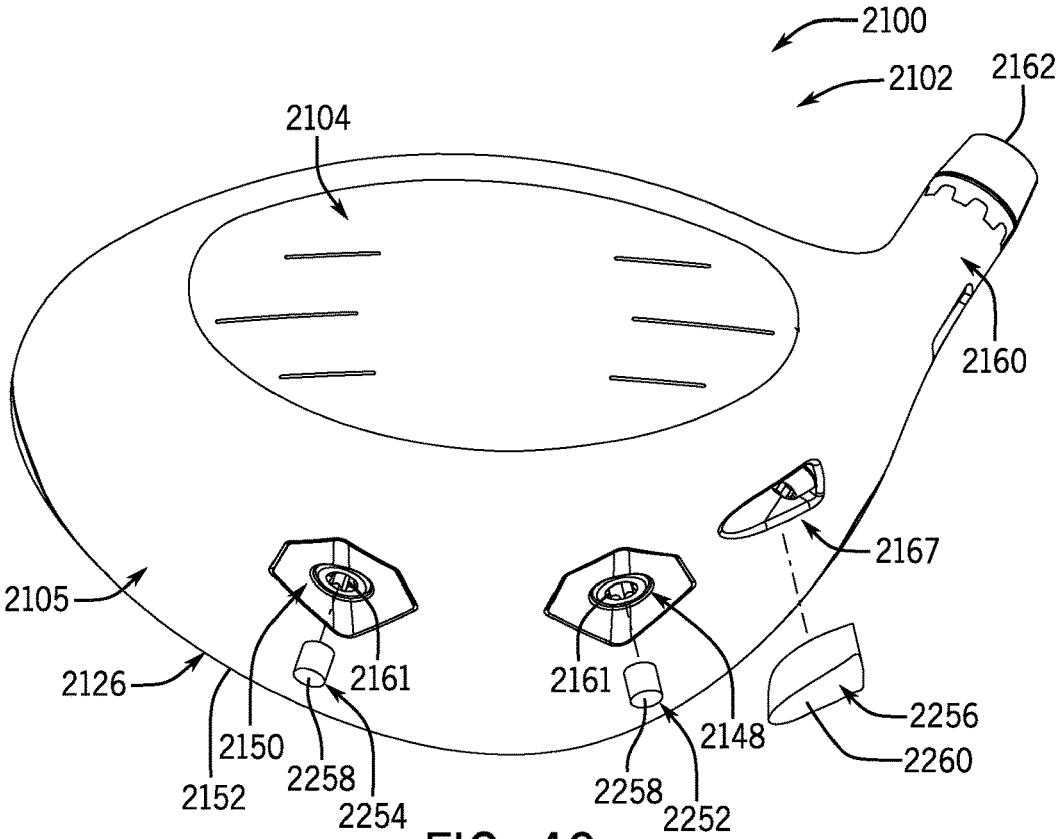
FIG. 40 is a bottom perspective view of the golf club head of FIG. 23 with a plug assembly exploded from a sole portion.
Figure 41:
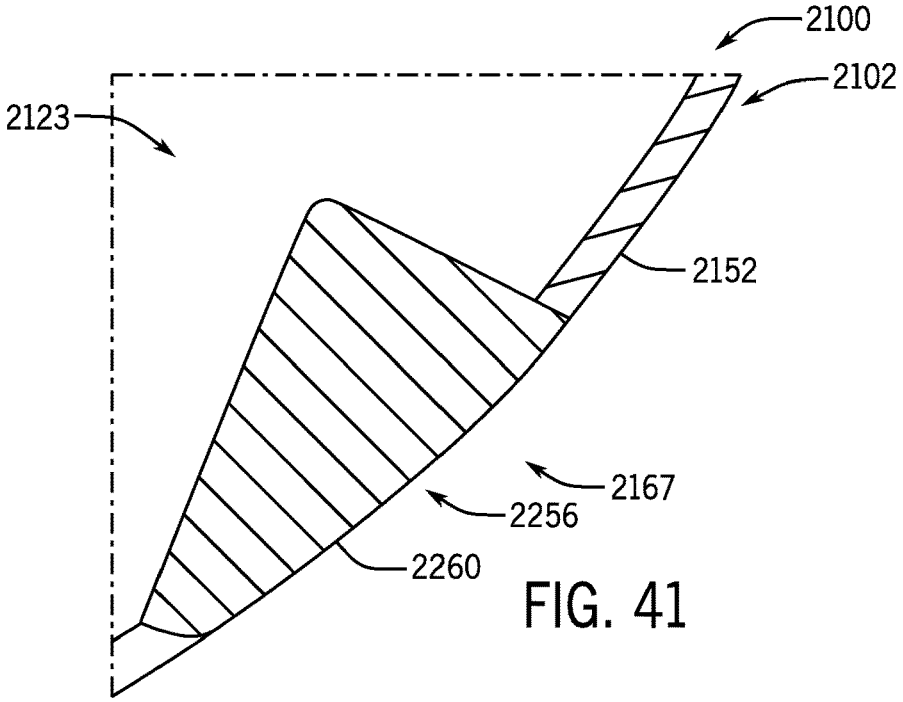
FIG. 41 is a cross-sectional view of the golf club head of FIG. 27 taken along plane 41-41 with the plug assembly arranged within a screw bore.
Figure 42:
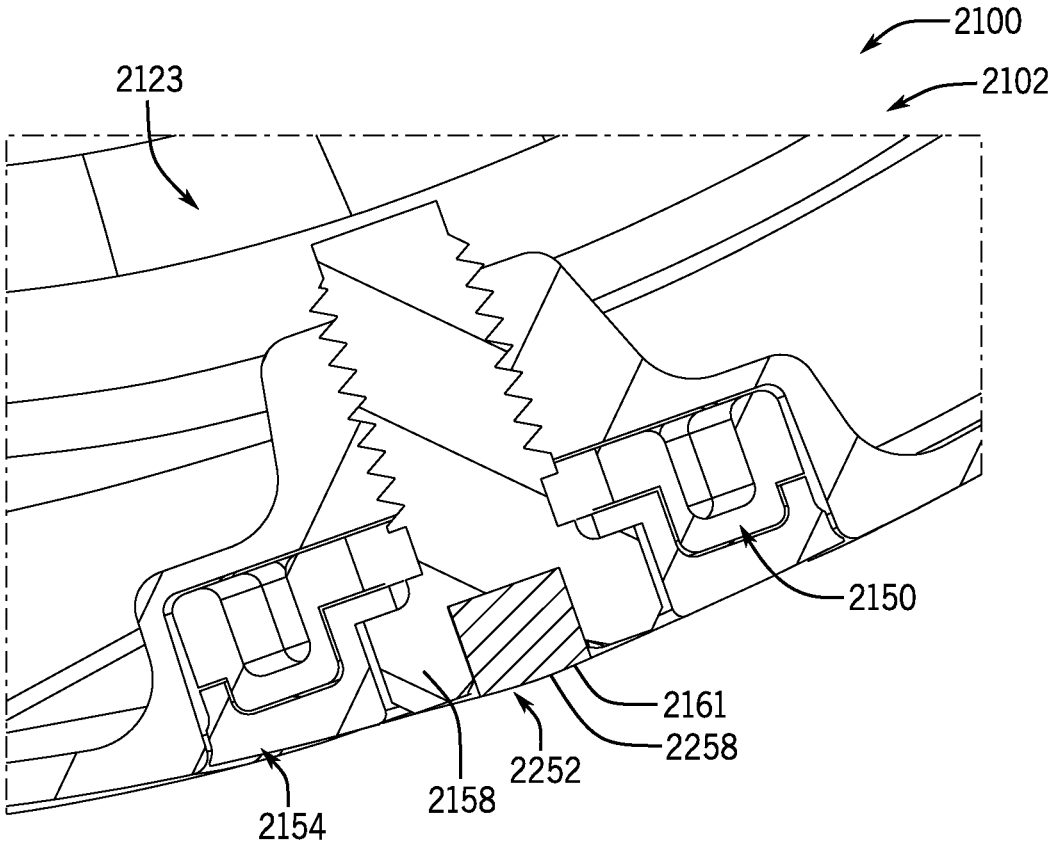
FIG. 42 is a cross-sectional view of the golf club head of FIG. 27 taken along plane 42-42 with the plug assembly arranged within a hosel pocket.

FIGS. 40-42 illustrate one embodiment of a plug assembly 2250 according to the present disclosure. In the illustrated embodiment, the plug assembly 2250 includes a first bore plug 2252, a second bore plug 2254, and a pocket plug 2256. The first bore plug 2252 is configured to be received within the screw bore 2161 of the first weight 2148 and the second bore plug 2254 is configured to be received within the screw bore 2161 of the second weight 2150. The pocket plug 2256 is configured to be received within the hosel pocket 2167. In general, by arranging the first bore plug 2252, the second bore plug 2254, and the pocket plug 2256 within the interruptions defined by the screw bores 2161 and the hosel pocket 2167, the plug assembly 2250 can reduce the amount of interruptions defined along the sole portion 2126 and further reduce aerodynamic drag along the body 2102.

In some embodiments, the first bore plug 2252, the second bore plug 2254, and the pocket plug 2256 may be selectively removable from the respective screw bores 2161 and the hosel pocket 2167, for example, via the use of a tool (e.g., a tweezers, pliers, etc.). Alternatively or additionally, the first bore plug 2252, the second bore plug 2254, and the pocket plug 2256 may include a tab that a user can grasp to for removal. In some embodiments, the first bore plug 2252, the second bore plug 2254, and the pocket plug 2256 may be fabricated from a rubber material, a polymer material, or a resin material. In some embodiments, the first bore plug 2252, the second bore plug 2254, and the pocket plug 2256 may be moldable (e.g., a clay material) and generally conform to the shape of the recess within which they are inserted as they are being inserted.

With specific reference to FIG. 41, with the first bore plug 2252 arranged within the screw bore 2161 of the first weight 2148, an external surface 2258 defined by the first bore plug 2252 is arranged flush with the outer sole surface 2152, which eliminates the interruption defined by the screw bore 2161 of the first weight 2148. It should be appreciated that the second bore plug 2254 would be arranged within the screw bore 2161 of the second weight 2150 in the same arrangement (i.e., with an external surface of the second bore plug 2254 being flush with the outer sole surface 2152). Turning to FIG. 42, with the pocket plug 2256 arranged within the hosel pocket 2167, an external surface 2260 of the pocket plug 2256 is arranged flush with the outer sole surface 2152, which eliminates the interruption defined by the hosel pocket 2167. Arranging the external surfaces 2258, 2260 of the plug assembly 2250 flush with the outer sole surface 2152 maintains the continuity of the outer sole surface 2152, which streamlines the outer sole surface 2152 and aids in delaying flow separation. All these factors aid in reducing aerodynamic drag, for example, during a down swing and increase club head speed and distance provided by the golf club head 2100.

It should be appreciated that the properties and techniques of the plug assembly 2250 may be applied to other interruptions defined along a golf club head and the scope of the plug assembly 2250 is not limited to weights and hosel pockets. For example, the plug assembly 2250 may be adapted to include plugs for any interruptions arranged along a crown or sole of a golf club head (e.g., within a slot, step, or channel).

Any of the embodiments described herein may be modified to include any of the structures or methodologies disclosed in connection with different embodiments. Further, the present disclosure is not limited to golf club heads of the type specifically shown.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto.

The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A golf club head, comprising:

a body defining an internal cavity and including:

a crown portion extending along a top side of the body;

a sole portion extending along a bottom side of the body;

a skirt portion extending along a perimeter of an aft side of the body between the crown portion and the sole portion, the skirt portion including a distalmost point along a toe side of the body; and a hosel extending from a heel side of the body, wherein the hosel defines a hosel axis that intersects a ground plane at a ground intersection point, wherein the crown portion includes a vertex point adjacent to the hosel that is defined as an uppermost point along the crown portion adjacent to the hosel where a slope of a line tangent to an uppermost edge of the crown portion is parallel to the ground plane, wherein the vertex point defines a vertex height in a direction normal to the ground plane, wherein the vertex height is less than 75% of a maximum height of the body, and wherein a height of the distalmost point in the direction normal to the ground plane is less than 65% of the maximum height of the body.

2. The golf club head of claim 1, wherein the crown portion includes a crown plate.

3. The golf club head of claim 2, wherein the skirt portion is formed by the crown plate.

4. The golf club head of claim 1, further comprising a weight coupled to the sole portion that includes a screw bore, and a hosel pocket arranged on the sole portion.

5. The golf club head of claim 4, further comprising a plug assembly that is configured to fill the screw bore and the hosel pocket so that external surfaces of the plug assembly are flush with an outer sole surface.

6. The golf club head of claim 1, further comprising an aftmost point arranged along the skirt portion, wherein a parting line is defined as an imaginary line connecting the distalmost point along the toe side and the aftmost point, and wherein the parting line extends downward in a direction toward the ground plane to define a parting line slope or grade of less than 10%.

7. A golf club head, comprising:

a body defining an internal cavity and including:

a crown portion extending along a top side of the body;

a sole portion extending along a bottom side of the body;

a skirt portion extending along a perimeter of an aft side of the body between the crown portion and the sole portion, the skirt portion including a distalmost point along a toe side of the body and an aftmost point, wherein a parting line is defined as an imaginary line connecting the distalmost point along the toe side and the aftmost point; and a hosel extending from a heel side of the body, wherein the hosel defines a hosel axis that intersects a ground plane at a ground intersection point, wherein the parting line extends downward in a direction toward the ground plane to define a parting line slope or grade of between 5% and 10%, wherein the crown portion includes a vertex point adjacent to the hosel that is defined as an uppermost point along the crown portion adjacent to the hosel where a slope of a line tangent to an uppermost edge of the crown portion is parallel to the ground plane, wherein the vertex point defines a vertex height in a direction normal to the ground plane, wherein the vertex height is less than 75% of a maximum height of the body, and wherein a height of the distalmost point in the direction normal to the ground plane is less than 65% of the maximum height of the body.

8. The golf club head of claim 7, wherein the crown portion includes a crown plate.

9. The golf club head of claim 8, wherein the skirt portion is formed by the crown plate.

10. The golf club head of claim 7, further comprising a weight coupled to the sole portion that includes a screw bore, and a hosel pocket arranged on the sole portion.

11. The golf club head of claim 10, further comprising a plug assembly that is configured to fill the screw bore and the hosel pocket so that external surfaces of the plug assembly are flush with an outer sole surface.

12. A golf club head, comprising:

a body defining an internal cavity and including:

a crown portion extending along a top side of the body;

a sole portion extending along a bottom side of the body;

a skirt portion extending along a perimeter of an aft side of the body between the crown portion and the sole portion; and a hosel extending from a heel side of the body, wherein the hosel defines a hosel axis that intersects a ground plane at a ground intersection point, wherein the body defines a half-head height that is half of a maximum height of the body defined in a direction normal to the ground plane, wherein the body defines a maximum area plane that defines a maximum cross-sectional area of the body taken in a plane parallel to the ground plane, wherein the maximum area plane is located at a height defined in a direction normal to the ground plane, and wherein a difference between the height of the maximum area plane and the half-head height is less than plus or minus 10% of the half-head height, wherein the crown portion includes a vertex point adjacent to the hosel that is defined as an uppermost point along the crown portion adjacent to the hosel where a slope of a line tangent to an uppermost edge of the crown portion is parallel to the ground plane, wherein the vertex point defines a vertex height in a direction normal to the ground plane, wherein the vertex height is less than 75% of a maximum height of the body, and wherein a height of a distalmost point in the direction normal to the ground plane is less than 65% of the maximum height of the body.

13. The golf club head of claim 12, wherein the crown portion includes a crown plate.

14. The golf club head of claim 13, wherein the skirt portion is formed by the crown plate.

15. The golf club head of claim 12, further comprising a weight coupled to the sole portion that includes a screw bore, and a hosel pocket arranged on the sole portion.

16. The golf club head of claim 15, further comprising a plug assembly that is configured to fill the screw bore and the hosel pocket so that external surfaces of the plug assembly are flush with an outer sole surface.

17. The golf club head of claim 12, wherein the skirt portion includes an aftmost point, wherein a parting line is defined as an imaginary line connecting the distalmost point along the toe side and the aftmost point, wherein the parting line extends downward in a direction toward the ground plane to define a parting line slope or grade of less than 10%.

* * * * *